US012364280B2

(12) United States Patent
An

(10) Patent No.: US 12,364,280 B2
(45) Date of Patent: Jul. 22, 2025

(54) SUPPORT ASSEMBLY FOR AEROSOL GENERATOR AND AEROSOL GENERATING APPARATUS HAVING SAME

(71) Applicant: KT&G CORPORATION, Daejeon (KR)

(72) Inventor: Hwi Kyeong An, Seoul (KR)

(73) Assignee: KT&G CORPORATION, Daejeon (KR)

( * ) Notice: Subject to any disclaimer, the term of this patent is extended or adjusted under 35 U.S.C. 154(b) by 478 days.

(21) Appl. No.: 17/747,117

(22) Filed: May 18, 2022

(65) Prior Publication Data

US 2022/0273033 A1 Sep. 1, 2022

Related U.S. Application Data

(63) Continuation of application No. 16/650,674, filed as application No. PCT/KR2019/002637 on Mar. 7, 2019, now Pat. No. 11,363,839.

(30) Foreign Application Priority Data

Apr. 10, 2018 (KR) ..... 10-2018-0041713

(51) Int. Cl.

| | |
|---|---|
| ***A24F 40/40*** | (2020.01) |
| ***A24F 40/46*** | (2020.01) |
| ***A24F 40/85*** | (2020.01) |
| *A24F 40/20* | (2020.01) |

(52) U.S. Cl.

CPC ..... *A24F 40/40* (2020.01); *A24F 40/46* (2020.01); *A24F 40/85* (2020.01); *A24F 40/20* (2020.01)

(58) Field of Classification Search

CPC ..... A24F 40/20; A24F 40/40

See application file for complete search history.

(56) References Cited

U.S. PATENT DOCUMENTS 5,769,188 A 6/1998 Okabe et al.
6,615,840 B1 * 9/2003 Fournier ..... A24D 1/02 131/365

(Continued)

FOREIGN PATENT DOCUMENTS

CN 1470198 A 1/2004
CN 101124414 A 2/2008

(Continued)

OTHER PUBLICATIONS

Communication dated Mar. 2, 2021, from the Japanese Patent office in application No. 2020-518493.

(Continued)

*Primary Examiner* — James Harvey
(74) *Attorney, Agent, or Firm* — Sughrue Mion, PLLC

(57) ABSTRACT

An aerosol generating source support assembly includes: an inner cylinder which is hollow, having a support space, and arranged to surround and support at least a portion of an aerosol generating source; and an outer cylinder connected to the inner cylinder and arranged to movably support the inner cylinder such that the inner cylinder moves between a coupling position in which the outer cylinder is coupled with the inner cylinder and a separation position in which at least a portion of the inner cylinder is separated from the outer cylinder.

21 Claims, 19 Drawing Sheets

(56) References Cited

U.S. PATENT DOCUMENTS

| | | | | |
|---|---|---|---|---|
| 6,803,550 | B2 * | 10/2004 | Sharpe | H05B 6/105 219/635 |
| 7,765,644 | B2 | 8/2010 | Ueyama et al. | |
| 11,266,182 | B2 * | 3/2022 | Mironov | A24F 40/50 |
| 2014/0299125 | A1 | 10/2014 | Buchberger | |
| 2016/0021933 | A1 | 1/2016 | Thorens et al. | |
| 2017/0095639 | A1 | 4/2017 | Trzecieski | |
| 2017/0172215 | A1 | 6/2017 | Li et al. | |
| 2020/0245681 | A1 | 8/2020 | An | |
| 2021/0137163 | A1 | 5/2021 | An | |
| 2022/0273033 | A1 * | 9/2022 | An | A24F 40/46 |
| 2022/0295880 | A1 * | 9/2022 | An | A24F 40/40 |

FOREIGN PATENT DOCUMENTS

| | | | |
|---|---|---|---|
| CN | 102845833 | A | 1/2013 |
| CN | 104146341 | A | 11/2014 |
| CN | 204317504 | U | 5/2015 |
| CN | 105050436 | A | 11/2015 |
| CN | 205648908 | U | 10/2016 |
| JP | 2004-97559 | A | 4/2004 |
| JP | 2014-216287 | A | 11/2014 |
| JP | 2015-013192 | A | 1/2015 |
| JP | 2017-163974 | A | 9/2017 |
| JP | 3214927 | U | 2/2018 |
| KR | 10-2015-0025725 | A | 3/2015 |
| KR | 10-1631286 | B1 | 6/2016 |
| KR | 10-2016-0109073 | A | 9/2016 |
| KR | 10-2018-0023621 | A | 3/2018 |
| KR | 10-2019-0048731 | A | 5/2019 |
| WO | 2015/174657 | A1 | 11/2015 |
| WO | 2017186455 | A1 | 11/2017 |

OTHER PUBLICATIONS

Extended European Search Report dated Dec. 14, 2021 from the European Patent Office in EP Application No. 19786080.2.

Notice of Non-Final Rejection of Korean Application No. 10-2018-0041713 dated Dec. 5, 2019.

International Search Report of PCT/KR2019/002637 dated Jun. 12, 2019 [PCT/ISA/210].

Office Action dated Feb. 7, 2022 from the China National Intellectual Property Administration in CN Application No. 201980004585.5.

Office Action issued Jun. 26, 2020 in Korean Application No. 10-2018-0041713.

Notice of Allowance issued in parent U.S. Appl. No. 16/650,674 mailed Feb. 23, 2022.

Office Action issued in parent U.S. Appl. No. 16/650,674 mailed Nov. 10, 2021.

Japanese Office Action dated Oct. 4, 2022 in Japanese Application No. 2021-128864.

Office Action issued Mar. 20, 2025 in Chinese Patent Application No. 202210670188.5.

* cited by examiner

SUPPORT ASSEMBLY FOR AEROSOL GENERATOR AND AEROSOL GENERATING APPARATUS HAVING SAME

CROSS-REFERENCE TO RELATED APPLICATIONS

This application is a continuation of U.S. application Ser. No. 16/650,674 filed Mar. 25, 2020, now issued as U.S. Pat. No. 11,363,839, which is a national stage of International Application No. PCT/KR2019/002637 filed Mar. 7, 2019, which claims priority from Korean Patent Application No. 10-2018-0041713, filed on Apr. 10, 2018, in the Korean Intellectual Property Office, the disclosures of which are incorporated by reference herein in their entireties.

TECHNICAL FIELD

The present disclosure relates to an aerosol generating source support assembly and an aerosol generating apparatus having the aerosol generating source support assembly, and more particularly, to an aerosol generating source support assembly that is easy to clean and an aerosol generating apparatus having the aerosol generating source support assembly.

BACKGROUND ART

In recent years, there is increasing demand for an apparatus (i.e., an aerosol generating apparatus) for heating a cigarette to generate an aerosol from components in the cigarette. In an aerosol generating apparatus including a heater for heating a cigarette, the cigarette may be separated from the aerosol generating apparatus after use of the cigarette and a new cigarette may be inserted into the aerosol generating apparatus.

The aerosol generating apparatus has to be kept clean in order to generate a high-quality aerosol even after the aerosol generating apparatus is repeatedly used. However, debris may accumulate inside the aerosol generating apparatus while the cigarette is heated to generate the aerosol. The accumulated debris may contaminate the aerosol generating apparatus, thus degrading its performance and causing discomfort and inconvenience for a user.

In general, the cleaning of the inside of the aerosol generating apparatus is performed in a manner in which, while holding the aerosol generating apparatus by hand, the user points a cigarette insertion hole toward the ground and shakes the aerosol generating apparatus. However, since debris stuck inside the aerosol generating apparatus are not easily discharged from the aerosol generating apparatus, the user has to tap the cigarette insertion hole of the aerosol generating apparatus against a hard surface such as a table to remove the debris, and thus, cleaning is inconvenient and there is a risk of breaking a case.

In addition, when the aerosol generating apparatus is repeatedly used for a long time, debris may get stuck to an inner area of the aerosol generating apparatus which is not exposed to the outside through the cigarette insertion hole. In order to clean the inner area which is not exposed to the outside of the aerosol generating apparatus, only a special tool such as a screwdriver can be used to forcibly disassemble some parts thereof. In this light, it is difficult to clean the aerosol generating apparatus.

DESCRIPTION OF EXEMPLARY EMBODIMENTS

Technical Problem

Provided are an aerosol generating source support assembly that is convenient to use and easy to clean and an aerosol generating apparatus including the aerosol generating source support assembly.

In addition, provided is an aerosol generating apparatus that has improved durability and stability, maintains a clean interior, and is easy to manage.

In addition, provided are an aerosol generating source support assembly that is easy to clean because some components thereof are movable and thus a space for cleaning may be easily exposed to the outside, and an aerosol generating apparatus with the aerosol generating source support assembly detachably coupled thereto.

Solution to Problem

An aerosol generating source support assembly according to an aspect of the present disclosure includes: an inner cylinder which is hollow, having a support space, and arranged to surround and support at least a portion of an aerosol generating source; and an outer cylinder connected to the inner cylinder and arranged to movably support the inner cylinder such that the inner cylinder moves between a coupling position in which the outer cylinder is coupled with the inner cylinder and a separation position in which at least a portion of the inner cylinder is separated from the outer cylinder.

The inner cylinder may be rotatably coupled to the outer cylinder such that the inner cylinder rotates between the coupling position and the separation position, and wherein the inner cylinder is accommodated in the outer cylinder in the coupling position and at least a portion of the inner cylinder protrudes out of the outer cylinder in the separation position.

The outer cylinder may be hollow and have an accommodation space having an empty interior, and may include one side opening at one end of the accommodation space, another side opening at the other end of the accommodation space, and an open passage extending from the other side opening toward the one side opening to open a portion of the accommodation space to the outside.

The inner cylinder may be rotatably coupled to the outer cylinder such that the inner cylinder rotates about an axis crossing an extension direction of the outer cylinder toward the other side opening from the one side opening.

At least a portion of the inner cylinder may protrude to the outside of the accommodation space through the open passage when the inner cylinder rotates from the coupling position to the separation position.

The inner cylinder may further include, at one end portion thereof, an insertion opening for opening the support space to the outside, wherein the insertion opening of the inner cylinder may be aligned with the one side opening of the outer cylinder at the coupling position.

The inner cylinder may further include a shaft protruding toward the outer cylinder, and the outer cylinder may further include a rotation hole through which the shaft is inserted and rotated.

The inner cylinder may further include a pressing knob on an outer surface thereof to enable a user to operate the inner cylinder.

The inner cylinder further include a stopper protruding outward from the shaft, wherein the outer cylinder may include a top plate extending outward from the one side opening, the top plate contacting and supporting the stopper when the inner cylinder rotates toward the separation position.

The inner cylinder may further include an inner top plate extending to the outside of the insertion opening, and a handle arranged on the inner top plate to face the one side opening of the outer cylinder, wherein the one side opening of the outer cylinder may extend outward from a center of the one side opening to expose the handle to the outside.

The inner cylinder may further include, at the other end thereof, a heater insertion opening.

The inner cylinder may further include a cut-out hole to open a portion of the support space to the outside for cleaning, and the outer cylinder may further include an extended support surface, and, in the coupling position, the extended support surface is coupled to the cut-out hole of the inner cylinder and connected to an inner wall surface of the inner cylinder, thereby surrounding and supporting at least a portion of the aerosol generating source.

One of the cut-out hole of the inner cylinder and the extended support surface of the outer cylinder may be provided with a groove extending along an edge of the cut-out hole or the extended support surface, and the other of the cut-out hole of the inner cylinder and the extended support surface of the outer cylinder may be provided with a protruding border extending along the edge of the cut-out hole or the extended support surface and inserted into the groove.

Each of the groove and the protruding border may include a straight portion extending in an extension direction of the inner cylinder and the outer cylinder, and a curved portion which is connected to the straight portion near the other end of the inner cylinder, and extending in a circumferential direction of the inner cylinder, wherein a connection portion between the straight portion and the curved portion may be curved.

The rotation hole may extend along the extension direction of the outer cylinder to guide the shaft to move along the extension direction of the outer cylinder.

The rotation hole may include a protruding jaw protruding from the rotation hole to support the shaft, wherein the inner cylinder is movable between a release position and a close-contact position corresponding to the coupling position, wherein when the inner cylinder moves from the release position to the close-contact position, the shaft moves beyond the protruding jaw toward the one side opening of the outer cylinder, wherein when moving from the close-contact position to the release position, the shaft moves beyond the protruding jaw toward the other side opening of the outer cylinder, and wherein the inner cylinder is able to rotate with respect to the outer cylinder when the shaft is in the release position.

The inner cylinder may further include an inner top plate extending outside the insertion opening, and the outer cylinder may further include a top plate that extends outward from the one side opening and thus contacts an end portion of the inner top plate to hold the inner cylinder in the separation position when the inner cylinder rotates with respect to the outer cylinder.

The inner cylinder may be movably coupled to the outer cylinder such that the inner cylinder moves with respect to the outer cylinder in a direction in which the outer cylinder extends.

The outer cylinder may include an outer cylinder cut-out hole for exposing at least a portion of the accommodation space having an empty interior, and the inner cylinder may include an inner cylinder cut-out hole that exposes the support space to the outside and has a shape corresponding to the outer cylinder cut-out hole.

Both the outer cylinder cut-out hole and the inner cylinder cut-out hole may be closed at the coupling position to form an aerosol generating source insertion space for accommodating the aerosol generating source, and the outer cylinder cut-out hole and the inner cylinder cut-out hole may be exposed to the outside at the separation position.

A rail for guiding linear movement of the inner cylinder may be installed between the outer cylinder and the inner cylinder, in an area where the outer cylinder cut-out hole and the inner cylinder cut-out hole are engaged with each other.

A stopper for maintaining a position may be installed in one of the inner cylinder and the outer cylinder, and an accommodation groove coupled to the stopper may be installed in the other of the inner cylinder and the outer cylinder.

The outer cylinder may further include, at one end thereof, an insertion opening which extends in a circumferential direction and into which the aerosol generating source is inserted, and the inner cylinder may further include a heater insertion opening at an opposite end of the inner cylinder which is opposite to the insertion opening.

An aerosol generating apparatus according to another aspect of the present disclosure includes: a case, a hollow protrusion tube protruding from one end of the case and open to the outside, a heater installed in the case such that an end portion of the heater is positioned inside the protrusion tube, and configured to generate heat when an electric signal is applied.

The aerosol generating apparatus may include an aerosol generating source support assembly including: an inner cylinder which is hollow, having a support space, and arranged to surround and support at least a portion of an aerosol generating source; and an outer cylinder connected to the inner cylinder and arranged to movably support the inner cylinder such that the inner cylinder moves between a coupling position in which the outer cylinder is coupled with the inner cylinder and a separation position in which at least a portion of the inner cylinder is separated from the outer cylinder, wherein the outer cylinder is detachably coupled to the hollow protrusion tube.

Advantageous Effects of Disclosure

In an aerosol generating source support assembly according to exemplary embodiments of the present disclosure and an the aerosol generating apparatus including the aerosol generating source support assembly, the relative positions of an inner cylinder and an outer cylinder are changed between a coupling position in which the inner cylinder and the outer cylinder are coupled to each other and a separation position in which a portion of the inner cylinder is separated from the outer cylinder, and thus, an aerosol generating source may be stably supported while the aerosol generating source is in use, and a cleaning operation may be simply and reliably performed after the aerosol generating source is used.

In addition, since the relative positions of the inner cylinder and the outer cylinder may be fixed at the separation position in which at least a portion of the inner cylinder and the outer cylinder are separated from each other, the cleaning operation may be quickly and safely performed.

BEST MODE

The present disclosure will be more clearly understood by referring to the exemplary embodiments described below in detail with accompanying drawings. The present disclosure may, however, be embodied in many different forms and should not be construed as being limited to the exemplary embodiments set forth herein; rather these exemplary embodiments are provided so that this disclosure will thorough and complete, and will fully convey the inventive concept to one of ordinary skill in the art. The present disclosure is defined by the scope of the claims. Meanwhile, the terminology used herein is for the purpose of describing particular exemplary embodiments only and is not intended to be limiting of the present disclosure. As used herein, the singular forms "a," "an," and "the" are intended to include the plural forms as well, unless the context clearly indicates otherwise. It will be further understood that when a part and/or an operation "includes" or "comprises" an element, unless otherwise defined, the part and/or the operation may further include other elements, not excluding the other elements. Terms such as "first" and "second" may be used to describe various components, but the components should not be limited by the terms. The terms are only used to distinguish one component from another.

Figure 1:
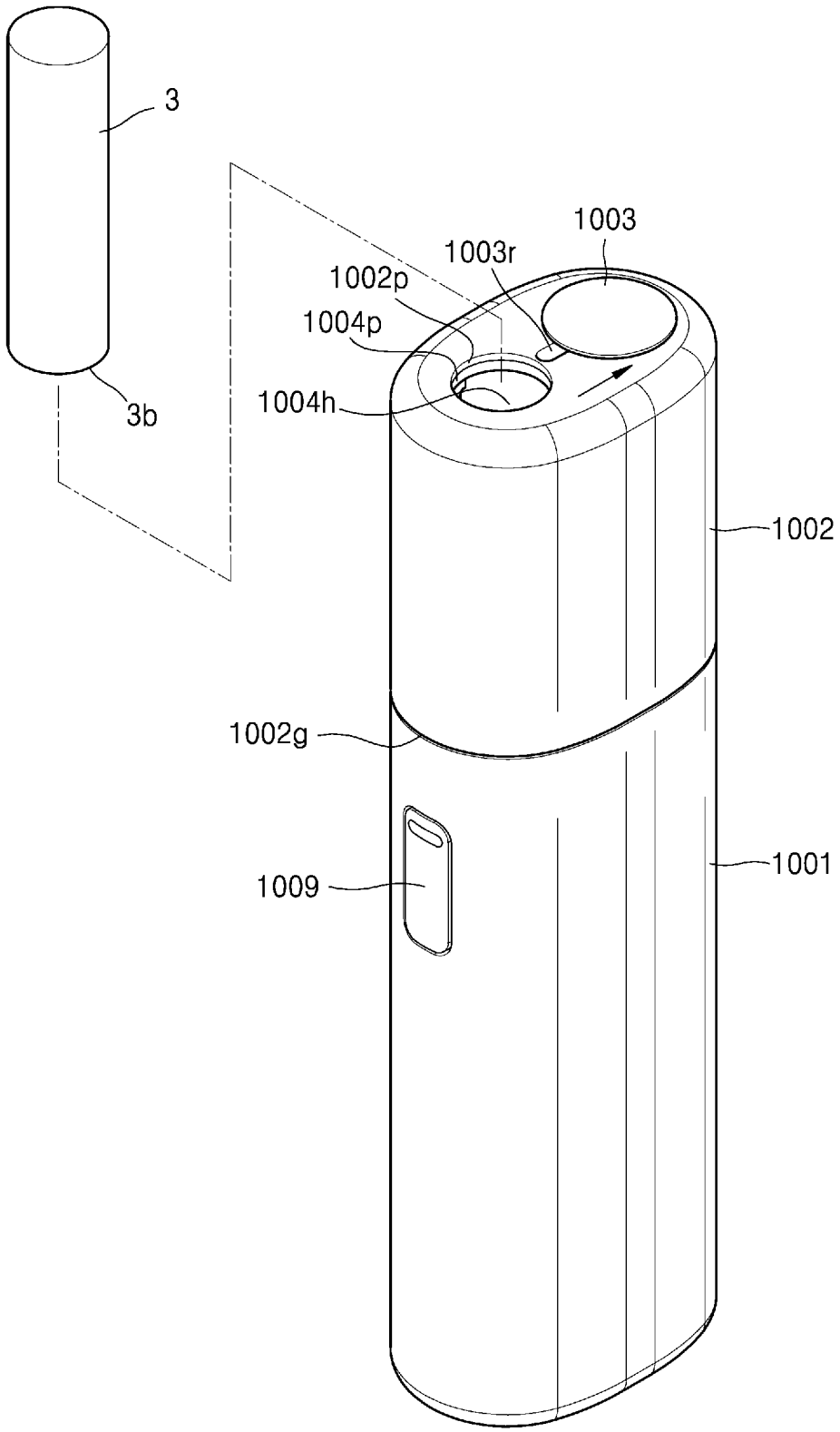
FIG. 1 is a perspective view illustrating an aerosol generating apparatus with an aerosol generating source support assembly according an exemplary embodiment.

FIG. 1 is a perspective view illustrating an aerosol generating apparatus with an aerosol generating source support assembly according an exemplary embodiment.

The aerosol generating source support assembly and aerosol generating apparatus according to the exemplary embodiment shown in FIG. 1 may include a case 1001 and a cover 1002. The cover 1002 is coupled with a first end of the case 1001, and thus the cover 1002 constitutes the outer appearance of the aerosol generating apparatus together with the case 1001.

The case 1001 constitutes the outer appearance of the aerosol generating apparatus 1 and functions to accommodate various components in a space formed therein, thereby protecting them.

The cover 1002 and the case 1001 may include a plastic material with low heat conductivity or a metal coated with a heat barrier material on its surface. The cover 1002 and the case 1001 may be fabricated through, for example, an injection molding method, a 3D printing method, or a method of assembling small parts fabricated through injection molding.

A locking device may be installed between the cover 1002 and the case 1001 to maintain the coupling between the cover 1002 and the case 1001. The locking device may include, for example, a protrusion and a groove. The coupling between the cover 1002 and the case 1001 may be maintained while the protrusion is inserted in the groove. The protrusion may be moved separated from the groove when a use presses a manipulation button.

The locking device may also include, for example, a magnet and a metal member that is attracted to the magnet. When a magnet is used for the locking device, a magnet may be installed on either the cover 1002 or the case 1001 and a metal that is attracted to the magnet may be attached to the other one. Alternatively, magnets may be installed on both the cover 1002 and the case 1001.

In the aerosol generating apparatus according to the exemplary embodiment shown in FIG. 1, the cover 1002 is not an essential configuration. Thus, the cover 1002 may not be installed as necessary.

An outside hole 1002*p* through which the cigarette 3 may be inserted is formed on the top surface of the cover 1002 coupled with the case 1001. Also, a rail 1003*r* is formed on the top surface of the cover 1002 at a position adjacent to the outside hole 1002*p*. A door 1003 that is capable of sliding along the top surface of the cover 1002 is installed on the rail 1003*r*. The door 1003 may slide in a straight line along the rail 1003*r*.

As the door 1003 moves along the rail 1003*r* in the direction indicated by the arrow in FIG. 1, the outside hole 1002*p* and an insertion hole 1004*p* that enable the cigarette 3 to be inserted into the case 1001 through the cover 1002 are exposed to the outside. The outside hole 1002*p* of the cover 1002 exposes the insertion hole 1004*p* of an accommodating path 1004*h* for accommodating the cigarette 3 to the outside.

When the outside hole 1002*p* is exposed to the outside by the door 1003, a user may insert an end portion 3*b* of the cigarette 3 into the outside hole 1002*p* and the insertion hole 1004*p*, thereby placing the cigarette 3 in the accommodating path 1004*h* formed inside the cover 1002.

In the exemplary embodiment, the door 1003 is installed to move in a straight line with respect to the cover 1002. However, the exemplary embodiment is not limited by the structure in which the door 1003 is coupled with the cover 1002. For example, the door 1003 may be rotatably mounted on the cover 1002 through a hinge assembly. In case of employing a hinge assembly, the door 1003 may be rotated toward a side of the outside hole 1002*p* along an extension of the top surface of the cover 1002. Otherwise, the door 1003 may be rotated in a direction away from the top surface of the cover 1002.

The rail 1003*r* has a concave groove shape, but the exemplary embodiment is not limited to the shape of the rail 1003*r*. For example, the rail 1003*r* may have a convex shape or may extend in a curved line instead of a straight line.

At the case 1001, a button 1009 is provided. As the button 1009 is manipulated, the operation of the aerosol generating apparatus may be controlled.

An outside air introduction gap 1002*g* that allows air to flow into the interior of the cover 1002 is formed at a portion between the cover 1002 and the case 1001 when the cover 1002 is coupled with the case 1001.

Figure 2:
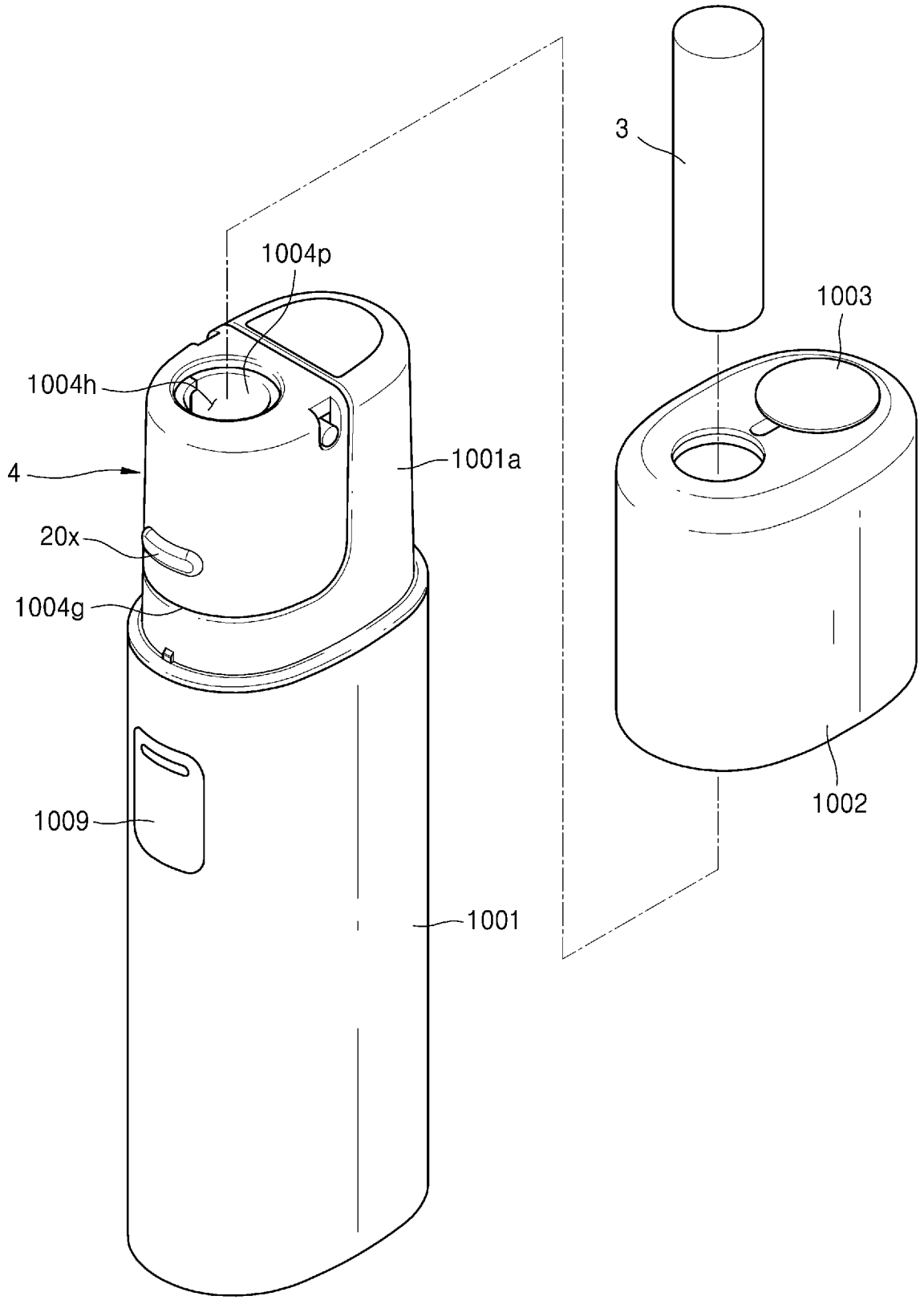
FIG. 2 is a perspective view illustrating an operating state in which some components are separated from the aerosol generating apparatus according to the exemplary embodiment shown in FIG. 1.
Figure 3:
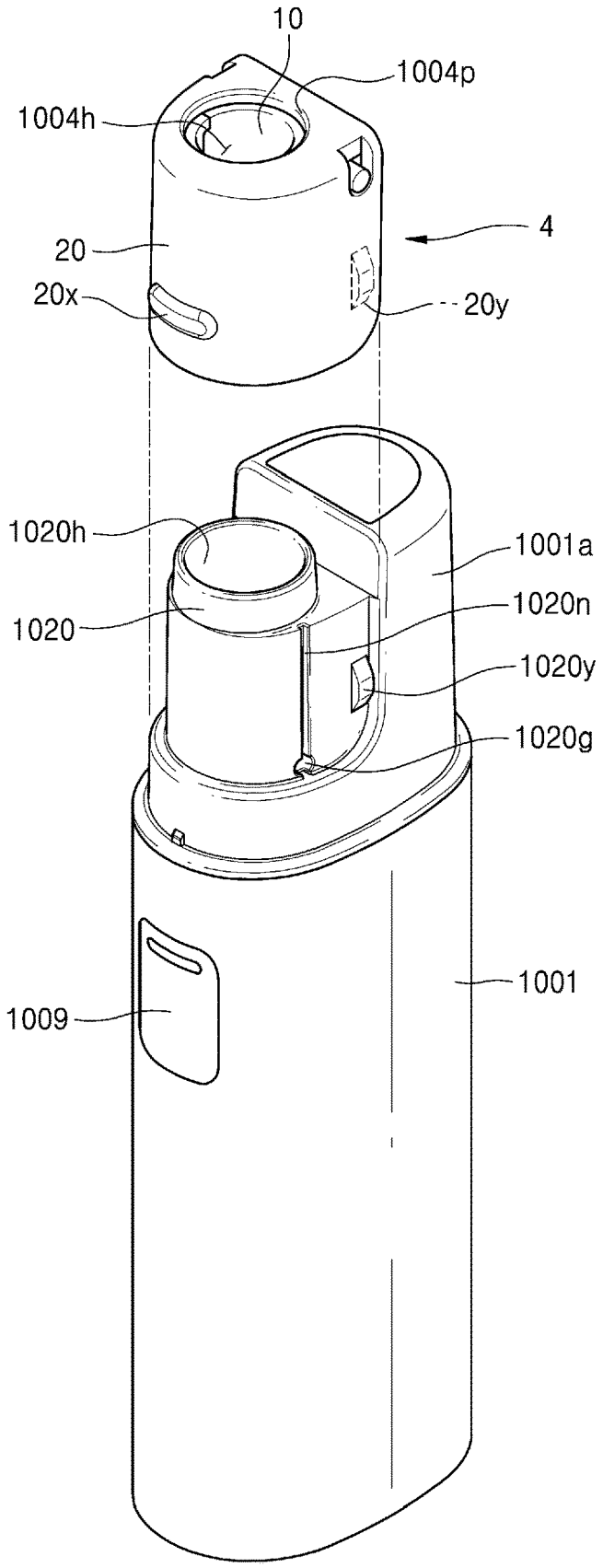
FIG. 3 is a perspective view illustrating an operating state in which some components are separated from the aerosol generating apparatus according to the exemplary embodiment shown in FIG. 2.
Figure 4:
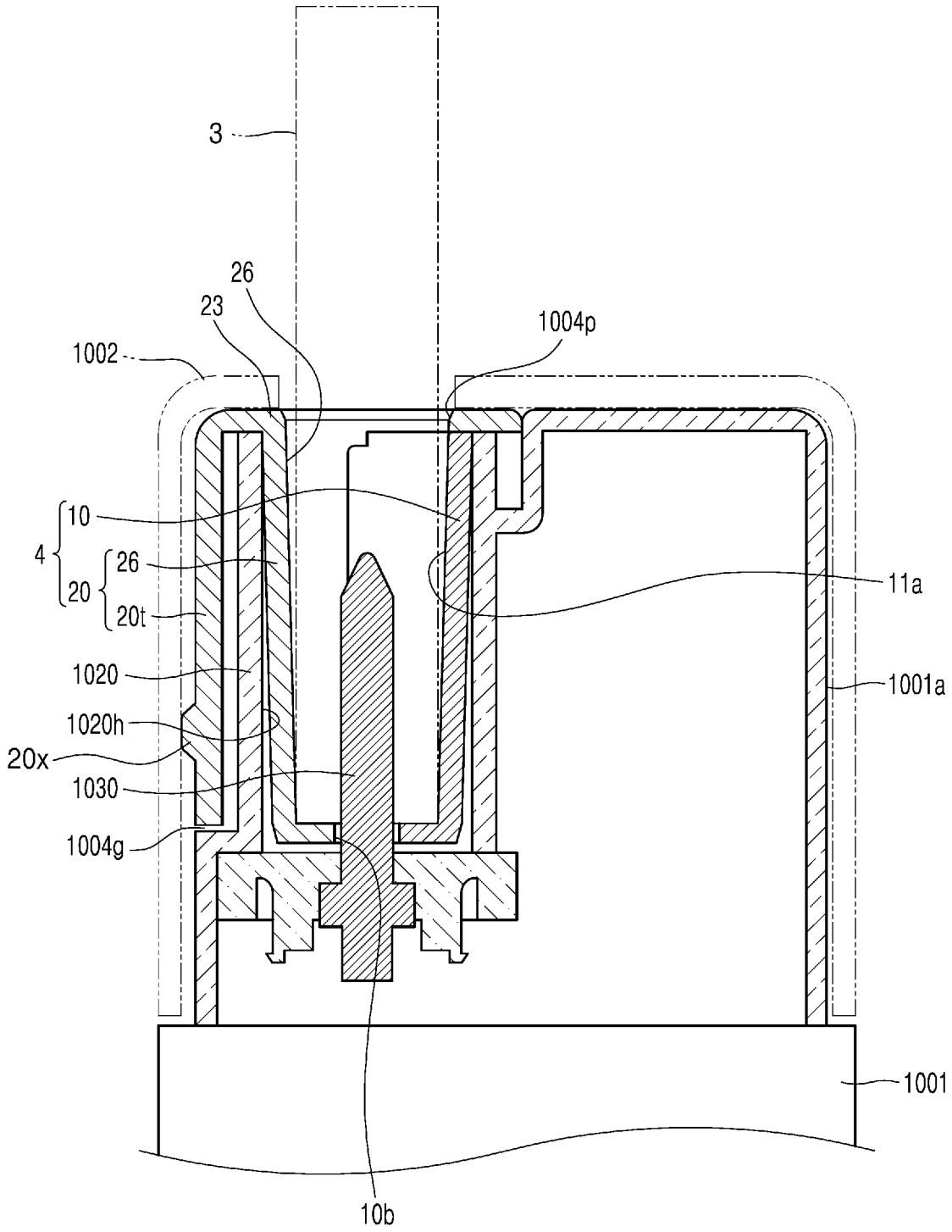
FIG. 4 is a side cross-sectional view illustrating some components in the aerosol generating apparatus according to the exemplary embodiment shown in FIG. 2.

FIG. 2 is a perspective view illustrating an operating state in which some components are separated from the aerosol generating apparatus according to the exemplary embodiment shown in FIG. 1. FIG. 3 is a perspective view illustrating an operating state in which some components are separated from the aerosol generating apparatus according to the exemplary embodiment shown in FIG. 2. FIG. 4 is a side cross-sectional view illustrating some components in the aerosol generating apparatus according to the exemplary embodiment shown in FIG. 2.

As shown in FIG. 4, in a state where the cigarette 3 is inserted in the aerosol generating apparatus, the user may hold the cigarette 3 by mouth and inhale aerosol.

When the use of the cigarette 3 is terminated, the user may perform a cleaning operation for removing a tobacco material, which may remain in the aerosol generating apparatus, after separating the cigarette 3 from the aerosol generating apparatus.

The cleaning of the aerosol generating apparatus may be performed in a manner that the user separates the cover 1002 from the case 1001 of the aerosol generating apparatus, separates an aerosol generating source support assembly 4 from the case 1001 to expose an internal space of the aerosol generating apparatus and the heater to the outside, and removes the tobacco material.

Referring to FIG. 2, the cover 1002 may be coupled to an end portion 1001*a* of the case 1001 to cover the aerosol generating source support assembly 4 coupled to the end portion 1001*a* of the case 1001. In addition, the cover 1002 may be separated from the case 1001 as necessary.

In order to remove the cigarette 3 from the aerosol generating apparatus after the use of the cigarette 3, the user may pull out the cigarette 3 from the case 1001 while or after rotating the cigarette 3 by hand.

When the cigarette 3 is separated from the case 1001 while or after being rotated, an coupling between the cigarette 3 and the heater may be released, and at the same time, the tobacco material attached to the cigarette 3 may be discharged to the outside of the case 1001 together with the cigarette 3.

When the cigarette 3 is pulled without rotating the cigarette 3 (or even when the cigarette 3 is pulled while the cigarette 3 is being rotated), the cigarette 3 may be separated from the case 1001. However, a portion of the cigarette 3, for example, a tobacco portion, may remain on the heater side without being discharged from the case 1001. In this case, the user may separate the aerosol generating source support assembly 4 from the case 1001, as shown in FIG. 3, after removing the cover 1002 from the case 1001. In this case, the tobacco portion remaining on the heater side is separated from the case 1001 together with the aerosol generating source support assembly 4. Thereafter, the user may remove the tobacco portion remaining in the aerosol generating source support assembly 4 separated from the case 1001.

Referring to FIGS. 3 and 4, the aerosol generating apparatus includes a case 1001, a protrusion tube 1020 which is hollow and protrudes from the end portion 1001*a* of the case 1001 and has an opening open to the outside, a heater 1030 installed in the case 1001 and positioned inside the protrusion tube 1020, and an aerosol generating source support assembly 4 that may be coupled to the protrusion tube 1020 and be separated from the protrusion tube 1020.

As shown in FIG. 2, when the user grasps and pulls the aerosol generating source support assembly 4 upward while the aerosol generating source support assembly 4 is coupled to the case 1001, the aerosol generating source support assembly 4 may be separated from the case 1001.

The aerosol-generating source support assembly 4 has a pressing knob 20*x* on the outer side surface of the aerosol generating source support assembly 4, which helps the user lift up the aerosol generating source support assembly 4. In the drawings, the pressing knob 20*x* protrudes from the outer surface of the aerosol generating source support assembly 4 and has a shape extending by a predetermined distance along the circumferential direction of the aerosol generating source support assembly 4.

However, the configuration of the pressing knob 20*x* is not limited thereto. For example, the pressing knob 20*x* may have a groove shape recessed from the outer surface of the aerosol-generating source support assembly 4.

Referring to FIG. 4, the protrusion tube 1020 surrounds and protects the heater 1030, and serves to support the aerosol generating source support assembly 4 when the aerosol generating source support assembly 4 is coupled to the protrusion tube 1020.

Referring to FIG. 3, the protrusion tube 1020 has an inclined protrusion 1020*y* protruding from the outer surface thereof and extending in an up and down direction, that is, in a moving direction of the aerosol generating source support assembly 4. The inclined protrusion 1020*y* has an inclination. The aerosol generating source support assembly 4 has an inclined groove 20*y* that may accommodate the inclined protrusion 1020*y* to support the inclined protrusion 1020*y*. At least portions of the surfaces of the inclined protrusion 1020*y* and the inclined groove 20*y* may form curved surfaces curved along the moving direction of the aerosol generating source support assembly 4. As the inclined protrusions 1020*y* and the inclined grooves 20*y* have the curved surfaces, the aerosol generating source support assembly 4 may be smoothly mounted or separated from the protrusion tube 1020.

Since a state in which the inclined protrusion 1020*y* is inserted in the inclined groove 20*y* is stably maintained while the aerosol generating source support assembly 4 is mounted on the protrusion tube 1020, the aerosol generating source support assembly 4 is not easily separated from the protrusion tube 1020 until the user pulls the aerosol generating source support assembly 4.

The installed positions of the inclined groove 20*y* and the inclined protrusion 1020*y* are not limited thereto. For example, the inclined groove 20*y* may be installed in the protrusion tube 1020 and the inclined protrusion 1020*y* may be installed in the aerosol generating source support assembly 4.

Since the protrusion tube 1020 is hollow and has a coupling passage 1020*h* into which at least a portion of the aerosol generating source support assembly 4 may be inserted. The upper end of the coupling passage 1020*h* is open to the outside in the upward direction of the aerosol generating apparatus.

The case 1001 is provided with a heater 1030 for heating the cigarette 3. The heater 1030 is installed in the case 1001 such that an upper end portion of the heater 1030 is positioned inside the protrusion tube 1020. When the cigarette 3 is accommodated in the aerosol generating source support assembly 4 in a state in which the aerosol generating source support assembly 4 is coupled to the protrusion tube 1020, the upper end portion of the heater 1030 is inserted into the bottom of an end portion of the cigarette 3.

The heater 1030 is electrically connected to a power supply device arranged inside the case 1001. When power is supplied from the power supply device to the heater 1030 in a state in which the cigarette 3 is inserted in the end portion of the heater 1030, the heater 1030 is heated and heats the cigarette 3.

Referring to FIG. 4, the aerosol generating source support assembly 4 may be inserted into the coupling passage 1020*h* inside the protrusion tube 1020 through the opening of the protrusion tube 1020. The aerosol generating source support assembly 4 has an inner cylinder 10 and an outer cylinder 20 for movably supporting the inner cylinder 10.

Referring to FIG. 4, the outer cylinder 20 of the aerosol generating source support assembly 4 has an extended support surface 26 protruding inward and spaced apart from an outer wall 20*t* having a substantially semi-cylindrical shape. When the aerosol generating source support assembly 4 is coupled to the protrusion tube 1020, the protrusion tube 1020 is inserted between the outer wall 20*t* and the extended support surface 26, and thus, a coupling state between the aerosol generating source support assembly 4 and the protrusion tube 1020 may be stably maintained.

According to the stable coupling structure between the aerosol generating source support assembly 4 and the protrusion tube 1020 as described above, even if external vibration due to an impact is applied to the aerosol generating apparatus, the separation or breakage of the components of the aerosol generating apparatus may be reduced. This may ensure good durability and stability even if the aerosol generating apparatus is used for a long time.

In addition, since the aerosol generating source support assembly 4 may be easily separated from the case 1001 when a cleaning operation is performed, the cleaning operation may be reliably and conveniently performed.

In addition, the protrusion tube 1020 may perform a function of directly supplying outside air to an end portion of the cigarette 3. Referring to FIG. 3, the protrusion tube 1020 has an air hole 1020*g* connecting the inside and the outside of the protrusion tube 1020, and an air flow path 1020*n* extending along a surface of the protrusion tube 1020 to guide the flow of air to the air hole 1020*g*.

A plurality of air holes 1020*g* may be provided spaced apart in the circumferential direction with respect to the center of the longitudinal direction of the protrusion tube 1020. The air hole 1020*g* and the air flow path 1020*n* form a flow passage of air for allowing air outside the protrusion tube 1020 to flow into the protrusion tube 1020.

Referring to FIG. 4, when the aerosol generating source support assembly 4 is coupled to the protrusion tube 1020, the extended support surface 26 of the aerosol generating source support assembly 4 is inserted into the protrusion tube 1020. While the extended support surface 26 of the aerosol generating source support assembly 4 moves downward along the protrusion tube 1020, the heater 1030 located inside the protrusion tube 1020 passes through a heater insertion opening 10*b* of the aerosol generating source support assembly 4.

With the aerosol generating source support assembly 4 coupled to the protrusion tube 1020, an end portion of the heater 1030 passes through the heater insertion opening 10*b* of the aerosol generating source support assembly 4 and is located inside the aerosol generating source support assembly 4. Therefore, when the cigarette 3 is accommodated in the aerosol generating source support assembly 4 in a state in which the aerosol generating source support assembly 4 is coupled to the protrusion tube 1020, the end portion of the heater 1030 is inserted into the cigarette 3.

In the exemplary embodiment shown in the drawings, a heater inserted into a cigarette is shown. However, the configuration of the heater is not limited thereto. For example, the heater may be made of a cylindrical film heater that may surround at least a portion of the outer surface of the cigarette. In the case of using a cylindrical film heater, the cylindrical film heater may be installed on the inner wall surface or the outer wall surface of the protrusion tube 1020.

When the user of the aerosol generating apparatus inserts the cigarette 3 into the receiving passage 1004*h*, the cigarette 3 moves along the aerosol generating source support assembly 4. When the end portion of the cigarette 3 reaches the bottom of the aerosol generating source support assembly 4, a feeling of contact between the bottom and the end portion of the cigarette 3 is transmitted to the user's hand holding the cigarette 3. Therefore, the user may easily mount the cigarette 3 to the aerosol generating apparatus by performing a simple operation of holding the cigarette 3 in the hand and pushing the cigarette 3 into the aerosol generating apparatus.

When the user separates the cigarette 3 from the aerosol generating source support assembly 4, the user may hold the cigarette 3 by hand and rotate it and pull the cigarette 3 out of the aerosol generating source support assembly 4. While the user holds and rotates the cigarette 3 by hand, the cigarette 3 and the heater 1030 attached to each other by the tobacco material may be completely separated.

After separating the cigarette 3 from the aerosol generating source support assembly 4, the user may clean the inside of the aerosol generating source support assembly 4. When the user separates the aerosol generating source support assembly 4 from the case 1001 to perform a cleaning operation, the user may grasp the aerosol generating source support assembly 4 by hand and pull the aerosol generating source support assembly 4 out of the case 1001.

Figure 5:
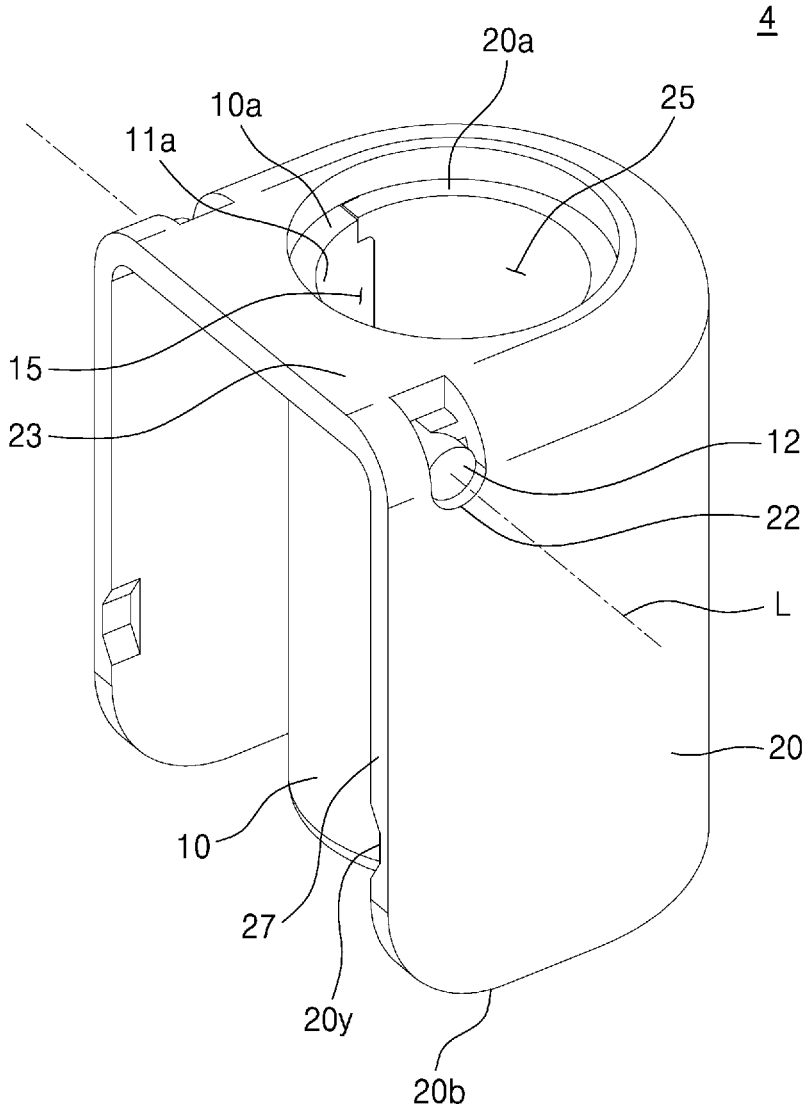
FIG. 5 is a perspective view illustrating the back of an aerosol generating source support assembly separated from the aerosol generating apparatus according to the exemplary embodiment shown in FIGS. 2 to 4.
Figure 6:
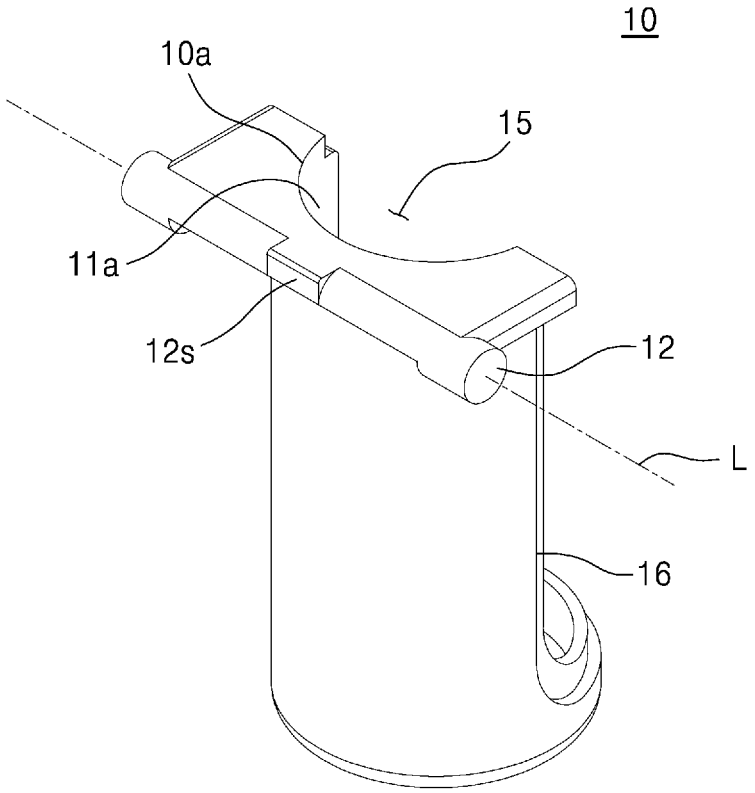
FIG. 6 is a perspective view illustrating some components of the aerosol generating source support assembly according to the exemplary embodiment shown in FIG. 5.
Figure 7:
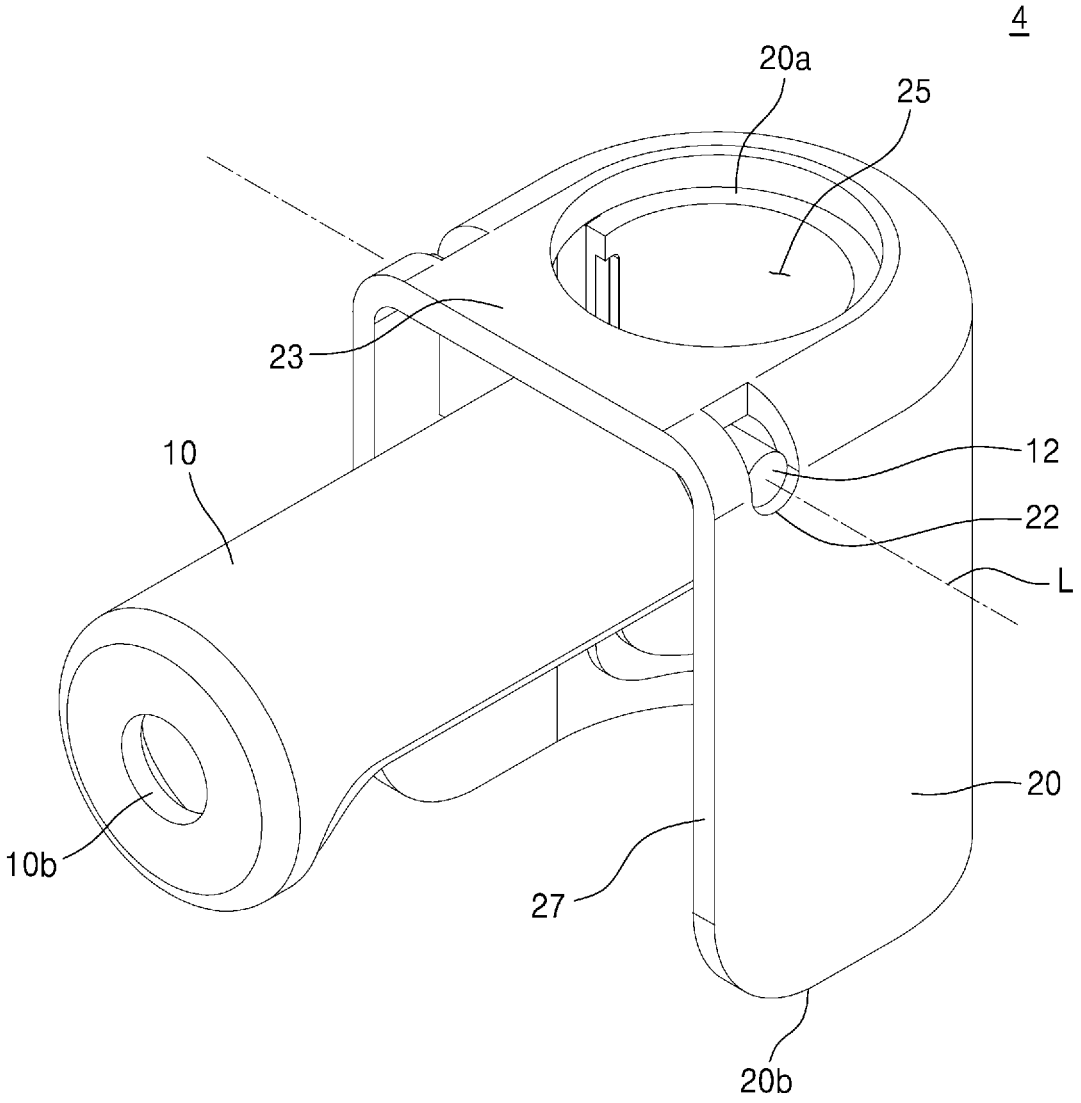
FIG. 7 is a perspective view illustrating an operating state of the aerosol generating source support assembly according to the exemplary embodiment shown in FIG. 5.

FIG. 5 is a perspective view illustrating the back of an aerosol generating source support assembly separated from the aerosol generating apparatus according to the exemplary embodiment shown in FIGS. 2 to 4. FIG. 6 is a perspective view illustrating some components of the aerosol generating source support assembly according to the exemplary embodiment shown in FIG. 5. FIG. 7 is a perspective view illustrating an operating state of the aerosol generating source support assembly according to the exemplary embodiment shown in FIG. 5.

The inner cylinder 10 and the outer cylinder 20 may include a material such as plastic, metal or rubber that is capable of withstanding heat well, or a combination of these materials.

The inner cylinder 10 is hollow and has a support space 15, and has an inner wall surface 11*a* capable of contacting, surrounding, and supporting at least a portion of the cigarette 3 that is an aerosol generating source.

The outer cylinder 20 is connected to the inner cylinder 10 and rotatably supports the inner cylinder 10. The position of the inner cylinder 10 may be changed between a coupling position in which the inner cylinder 10 is coupled to the outer cylinder 20, as shown in FIG. 5, and a separation position in which at least a portion of the inner cylinder 10 is separated from the outer cylinder 20, as shown in FIG. 7.

The inner cylinder 10 may be rotatably coupled to the outer cylinder 20 to rotate between the coupling position and the separation position. In the coupling position shown in FIG. 5, the inner cylinder 10 is accommodated inside the outer cylinder 20. In the separation position shown in FIG. 6, a portion of the inner cylinder 10 protrudes to the outside of the outer cylinder 20.

The outer cylinder 20 is hollow and has an accommodation space 25 having an empty interior so as to accommodate the inner cylinder 10 in the coupling position. The outer cylinder 20 includes one side opening 20*a* for opening one end of the accommodation space 25 to the outside in an upward direction, the other side opening 20*b* for opening the other end of the accommodation space 25 to the outside in a downward direction, and an open passage 27 extending from the other side opening 20*b* toward the one side opening 20*a* so as to open a portion of the accommodation space 25 to the outside in a lateral direction.

As shown in FIG. 5, the outer cylinder 20 may include an inclined groove 20*y* on an inner side surface thereof. The inclined groove 20*y* serves to accommodate and support the inclined protrusion 1020*y* of the protrusion tube 1020 shown in FIG. 3.

The inner cylinder 10 has a shaft 12 protruding toward the outer cylinder 20. The outer cylinder 20 has a rotation hole 22 for accommodating the shaft 12 and rotatably supporting the shaft 12.

The inner cylinder 10 is rotatably coupled to the outer cylinder 20 such that the inner cylinder 10 is capable of rotating about the axis L which crosses the extending direction of the outer cylinder 20 toward the other side opening 20*b* from the one side opening 20*a* of the outer cylinder 20. When the inner cylinder 10 rotates from the separation position toward the coupling position, at least a portion of the inner cylinder 10 protrudes to the outside of the accommodation space 25 through the open passage 27 of the outer cylinder 20.

Referring to FIG. 6, the inner cylinder 10 has an insertion opening 10*a*, which opens the support space 15 to the outside in the upward direction, at one end portion of the inner cylinder 10. When the inner cylinder 10 and the outer cylinder 20 are in the coupling position shown in FIG. 5, the insertion opening 10*a* of the inner cylinder 10 is aligned with the one side opening 20*a* of the outer cylinder 20, and thus, the insertion opening 10*a* of the inner cylinder 10 and the one side opening 20*a* of the outer cylinder 20 form the insertion hole 1004*p* shown in FIGS. 3 and 4.

Referring to FIG. 7, the inner cylinder 10 has a heater insertion opening 10*b* opened to the outside from the other end portion in the downward direction. In FIG. 4, when the aerosol generating source support assembly 4 is coupled to the case 1001, an upper end portion of the heater 1030 passes through the heater insertion opening 10*b* and is positioned inside the aerosol generating source support assembly 4. Therefore, when the cigarette 3 is inserted into the aerosol generating source support assembly 4 through the insertion hole 1004*p* as shown in FIG. 4, the upper end portion of the heater 1030 is inserted into the bottom of an end portion of the cigarette 3.

The size of the heater insertion opening 10*b* of the aerosol generating source support assembly 4 may correspond to the thickness of the heater 1030. For example, when the heater 1030 has a circular cross section, the heater insertion opening 10*b* also has a circular cross-sectional shape, and the inner diameter of the heater insertion opening 10*b* is formed to correspond to the outer diameter of the heater 1030.

The size of the inner diameter of the heater insertion opening 10*b* is not limited thereto. For example, the inner diameter of the heater insertion opening 10*b* may be formed to be larger than the outer diameter of the heater 1030, and thus, the inner surface of the heater insertion opening 10*b* may be spaced apart from the outer side of the heater 1030.

Figure 8:
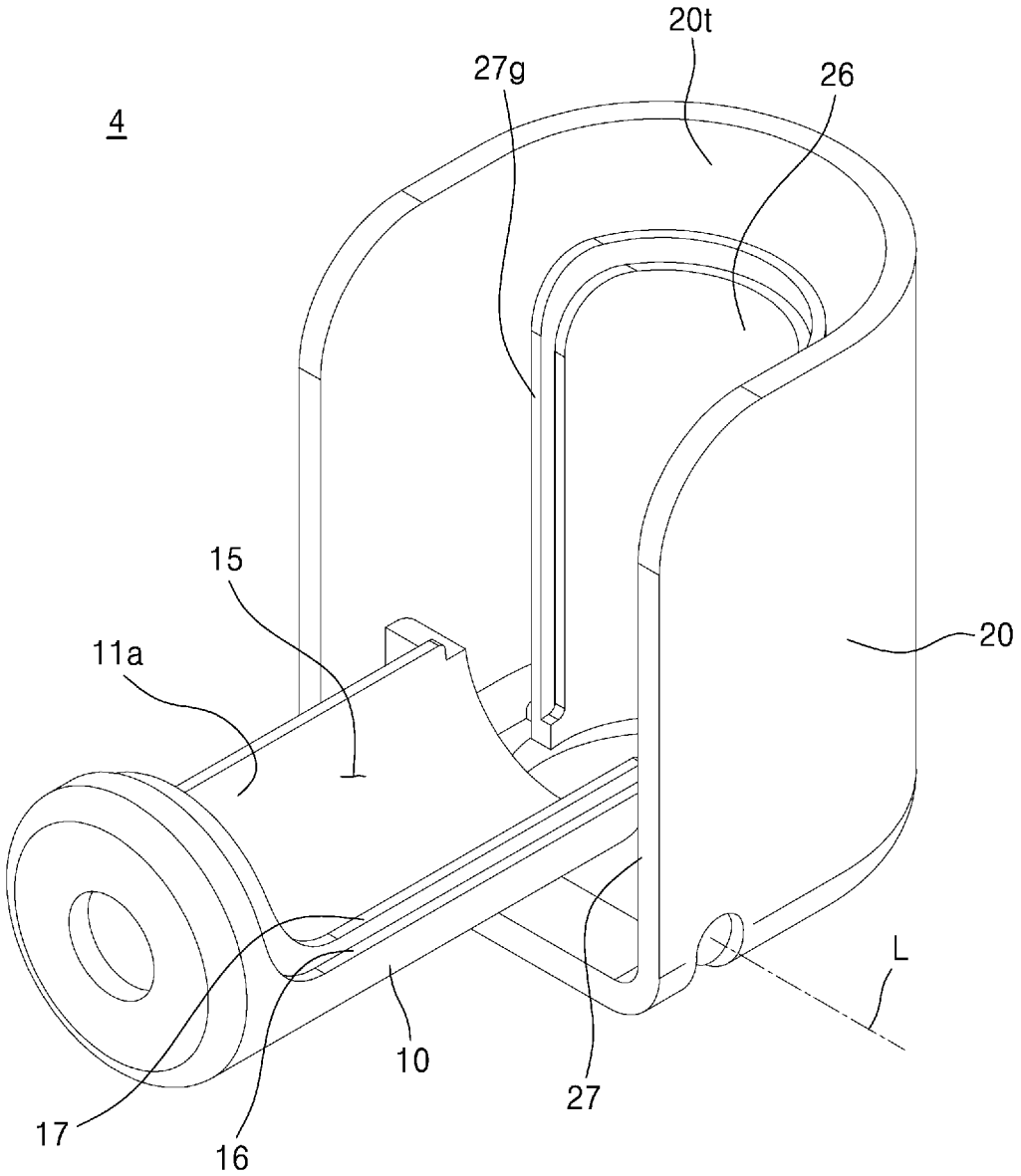
FIG. 8 is a perspective view illustrating the bottom of the aerosol generating source support assembly according to the exemplary embodiment shown FIG. 7.

FIG. 8 is a perspective view illustrating a bottom of the aerosol generating source support assembly according to the exemplary embodiment shown in FIG. 7.

The inner cylinder 10 has a cut-out hole 16 to open a portion of the support space 15 to the outside for easy cleaning.

In addition, the outer cylinder 20 has the extended support surface 26 protruding from the inner wall surface of the outer cylinder 20 so as to be coupled to the cut-out hole 16 of the inner cylinder 10 in the coupling position where the outer cylinder 20 is coupled to the inner cylinder 10.

When the outer cylinder 20 and the inner cylinder 10 are in the coupling position, the extended support surface 26 may be connected to the inner wall surface 11*a* of the inner cylinder 10, thereby extending in the circumferential direction in order to contact, surround, and support at least a portion of the cigarette 3. In the coupling position, the extended support surface 26 of the outer cylinder 20 and the inner wall surface 11*a* of the inner cylinder 10 may form a circular shape corresponding to the cross-sectional shape of the cigarette 3.

The extended support surface 26 of the outer cylinder 20 has a groove 27*g* extending along the edge of the extended support surface 26. In addition, the cut-out hole 16 of the inner cylinder 10 has a protruding border 17 protruding toward the outer cylinder 20 and extending along the edge of the cut-out hole 16.

When the inner cylinder 10 rotates to the coupling position and is accommodated in the outer cylinder 20, the protruding border 17 of the inner cylinder 10 may be inserted into the groove 27*g* of the outer cylinder 20, and thus, the coupling position in which the inner cylinder 10 and the outer cylinder 20 are coupled to each other may be stably maintained.

In the aerosol generating source support assembly 4 according to the exemplary embodiment shown in FIG. 8, the inner cylinder 10 has the protruding border 17 and the outer cylinder 20 has the groove 27*g*. However, exemplary embodiments are not limited by such a configuration. That is, the inner cylinder 10 may have a groove, and the outer cylinder 20 may have a protruding border.

When the cut-out hole 16 of the inner cylinder 10 rotates in a direction to be separated from the extended support surface 26 of the outer cylinder 20 and rotates to a separation position as shown in FIG. 8, the support space 15 of the inner cylinder 10 and the accommodation space 25 of the outer cylinder 20 are exposed to the outside. As such, when the support space 15 and the accommodation space 25 are exposed to the outside, it is possible to reliably and easily remove debris generated while the cigarette 3 generates aerosol and attached to the interior of the aerosol generating source support assembly 4.

The shaft 12 of the inner cylinder 10 has a stopper 12*s* protruding outward. The outer cylinder 20 has a top plate 23 extending outward from the one side opening 20*a*.

When the inner cylinder 10 rotates toward the separation position, the top plate 23 may come into contact with the stopper 12*s*, thereby supporting the stopper 12*s* to fix a rotation position of the stopper 12*s*. In other words, when the inner cylinder 10 rotates toward the separation position, the stopper 12*s* is tightly fitted to the lower surface of the top plate 23, and thus, the top plate 23 and the stopper 12*s* are in tight contact with each other. Therefore, when the inner cylinder 10 has rotated to the separation position shown in FIGS. 7 and 8, the rotated inner cylinder 10 at the separation position may be stably maintained due to the close contact between the stopper 12*s* and the top plate 23.

As described above, since the inner cylinder 10 may rotate between the coupling position, in which the inner cylinder 10 is coupled to the outer cylinder 20, and the separation position, in which the inner cylinder 10 rotates with respect to the outer cylinder 20 to be separated from the outer cylinder 20, a cleaning operation may be easily performed. In particular, since the inner cylinder 10 is fixed in the separation position by the action of the stopper 12*s*, the user may easily perform a cleaning operation in a state where the aerosol generating source support assembly is maintained in the separation position as shown in FIGS. 7 and 8.

MODE OF DISCLOSURE

Figure 9:
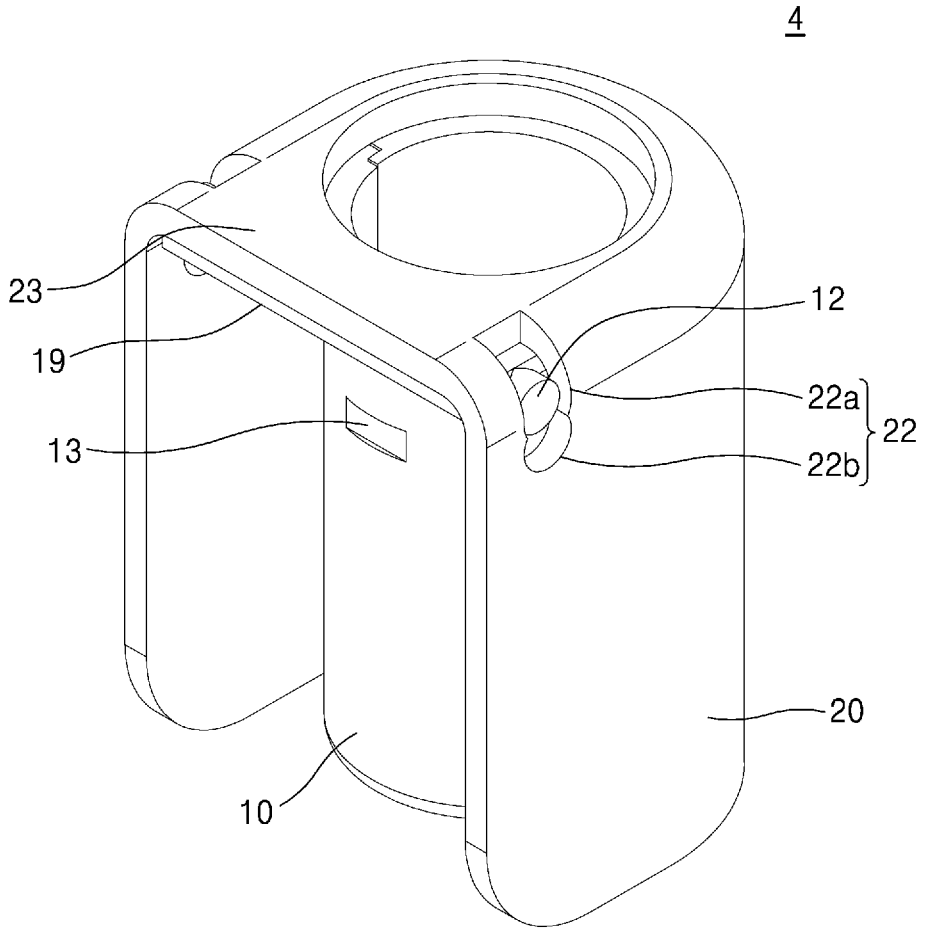
FIG. 9 is a perspective view of an aerosol generating source support assembly according to another exemplary embodiment.

FIG. 9 is a perspective view of an aerosol generating source support assembly according to another exemplary embodiment.

The aerosol generating source support assembly according to the exemplary embodiment shown in FIG. 9 includes an inner cylinder 10 which is hollow and has an empty interior, and an outer cylinder 20 rotatably supporting the inner cylinder 10.

The inner cylinder 10 includes a shaft 12, and the outer cylinder 20 includes a rotation hole 22 that rotatably supports the shaft 12.

The rotation hole 22 is formed to extend in the extending direction of the outer cylinder 20. The rotation hole 22 may serve to guide the shaft 12 to move in the extension direction of the outer cylinder 20 while the shaft 12 is inserted into the rotation hole 22. Therefore, the inner cylinder 10 and the shaft 12 may linearly move in the extending direction of the rotation hole 22.

Figure 10:
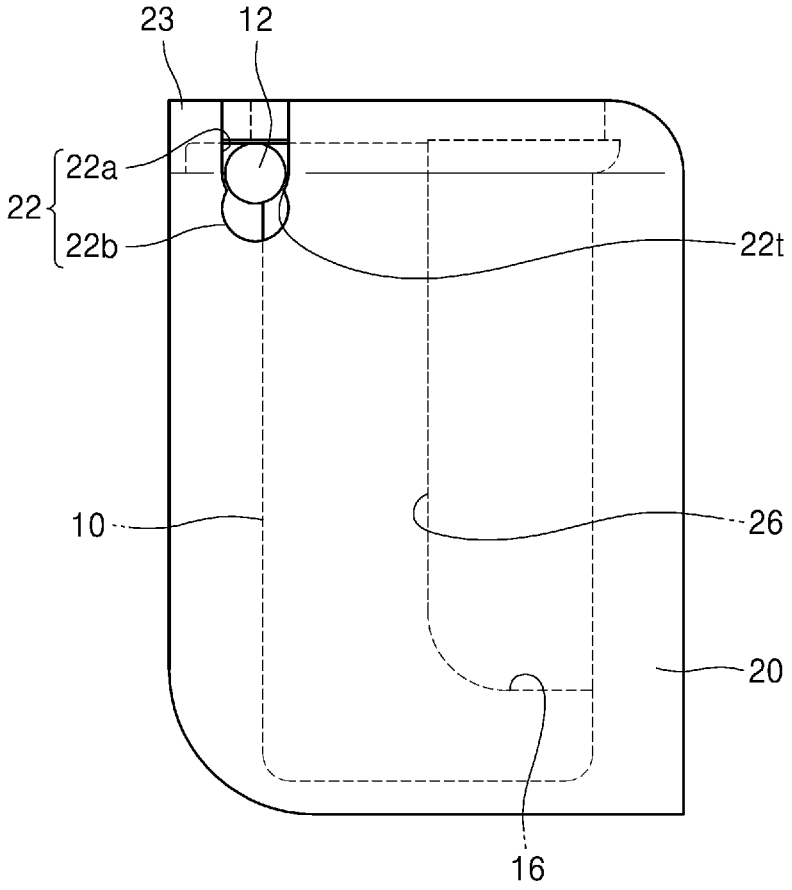
FIG. 10 is a side view of the aerosol generating source support assembly according to the exemplary embodiment shown in FIG. 9.

FIG. 10 is a side view of the aerosol generating source support assembly according to the exemplary embodiment shown in FIG. 9.

The outer cylinder 20 has a top plate 23 extending outward from one side opening of the upper side. As shown in FIG. 9, when the inner cylinder 10 is accommodated in the outer cylinder 20 and is in a coupling position in which the inner cylinder 10 is coupled to the outer cylinder 20, the inner cylinder 10 may linearly move in an upward direction toward the top plate 23 of the outer cylinder 20 and a downward direction away from the top plate 23.

The rotation hole 22 of the outer cylinder 20 has an upper hole 22*a* that is adjacent to the top plate 23 of the outer cylinder 20 and accommodates the shaft 12, and a lower hole 22*b* that is connected to the upper hole 22*a* and extends downward from the upper hole 22*a* to accommodate the shaft 12. The rotation hole 22 also has a protruding jaw 22*t* for supporting the shaft 12 by protruding inwardly between the upper hole 22*a* and the lower hole 22*b*.

Referring to FIG. 9, the inner cylinder 10 has a pressing knob 13 formed concave on the outer surface thereof. The user may move the inner cylinder 10 with respect to the outer cylinder 20 by operating the pressing knob 13 with a finger while holding the outer cylinder 20 by hand.

Exemplary embodiments are not limited by the configuration of the pressing knob 13. For example, the pressing knob 13 may have a protrusion shape protruding from the outer wall surface of the inner cylinder 10.

As shown in FIGS. 9 and 10, when the inner cylinder 10 is in a coupling position in which the inner cylinder 10 is coupled to the outer cylinder 20, the shaft 12 may pass above the protruding jaw 22*t* and thus the inner cylinder 10 may move toward the top plate 23 of the outer cylinder 20 to move to a close contact position in which the inner cylinder 10 is in close contact with the outer cylinder 20. Alternatively, the shaft 12 may pass below the protruding jaw 22*t* and thus the inner cylinder 10 may move toward a lower side away from the top plate 23 of the outer cylinder 20 to move to a release position.

FIG. 10 shows a close contact position in which the inner cylinder 10 comes into close contact with the top plate 23 of the outer cylinder 20 and a cut-out hole 16 of the inner cylinder 10 contacts an extended support surface 26 of the outer cylinder 20.

Figure 11:
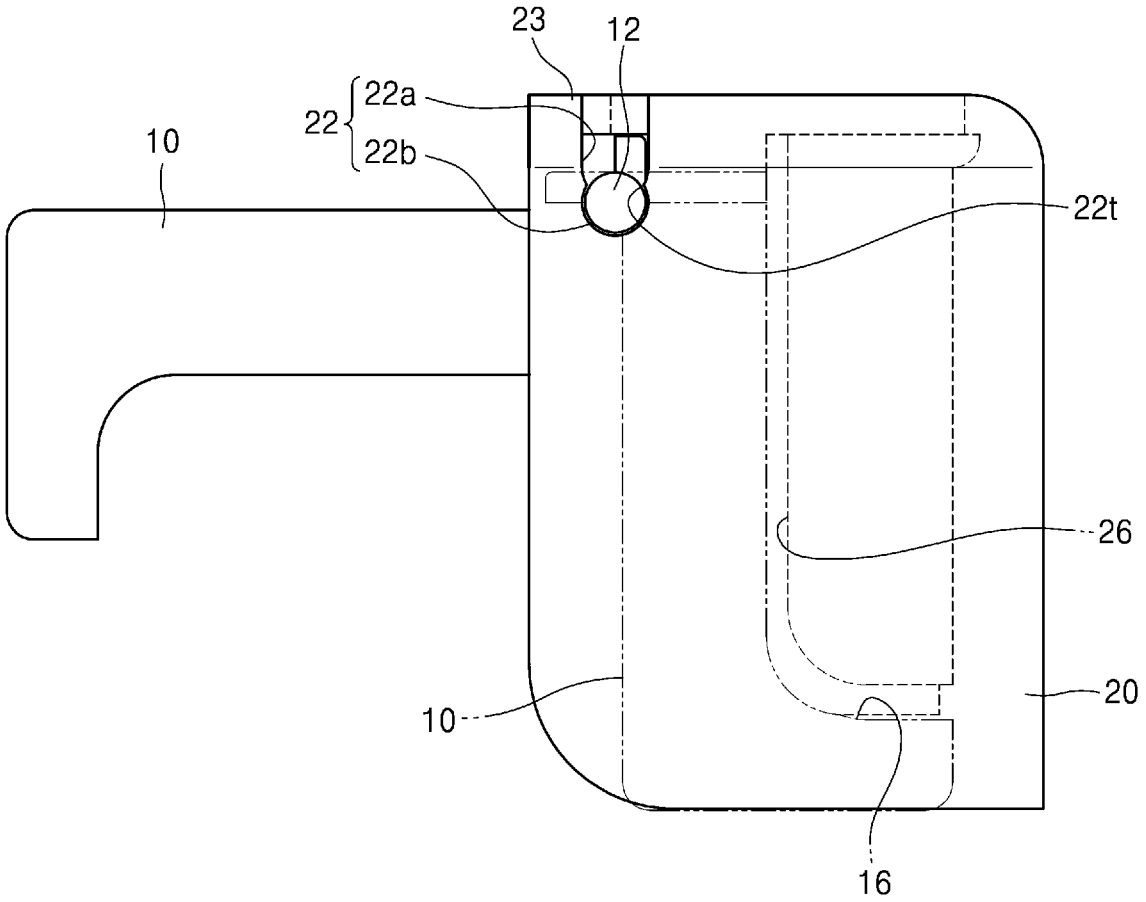
FIG. 11 is a side view illustrating an operating state of the aerosol generating source support assembly according to the exemplary embodiment shown in FIGS. 9 and 10.

FIG. 11 is a side view illustrating an operating state of the aerosol generating source support assembly according to the exemplary embodiment shown in FIGS. 9 and 10.

The inner cylinder 10 shown by the dashed line in FIG. 11 shows that the inner cylinder 10 has moved downward away from the top plate 23 of the outer cylinder 20 to a release position. Thus, the cut-out hole 16 of the inner cylinder 10 is spaced apart from the extended support surface 26 of the outer cylinder 20. As such, the inner cylinder 10 may rotate with respect to the outer cylinder 20 in the release position.

The inner cylinder 10 shown by the solid line in FIG. 11 shows the inner cylinder 10 that has moved to a separation position after rotating with respect to the outer cylinder 20. A portion of the inner cylinder 10 in the separation position may protrude to the outside of the outer cylinder 20 to maintain a posture for cleaning.

Figure 12:
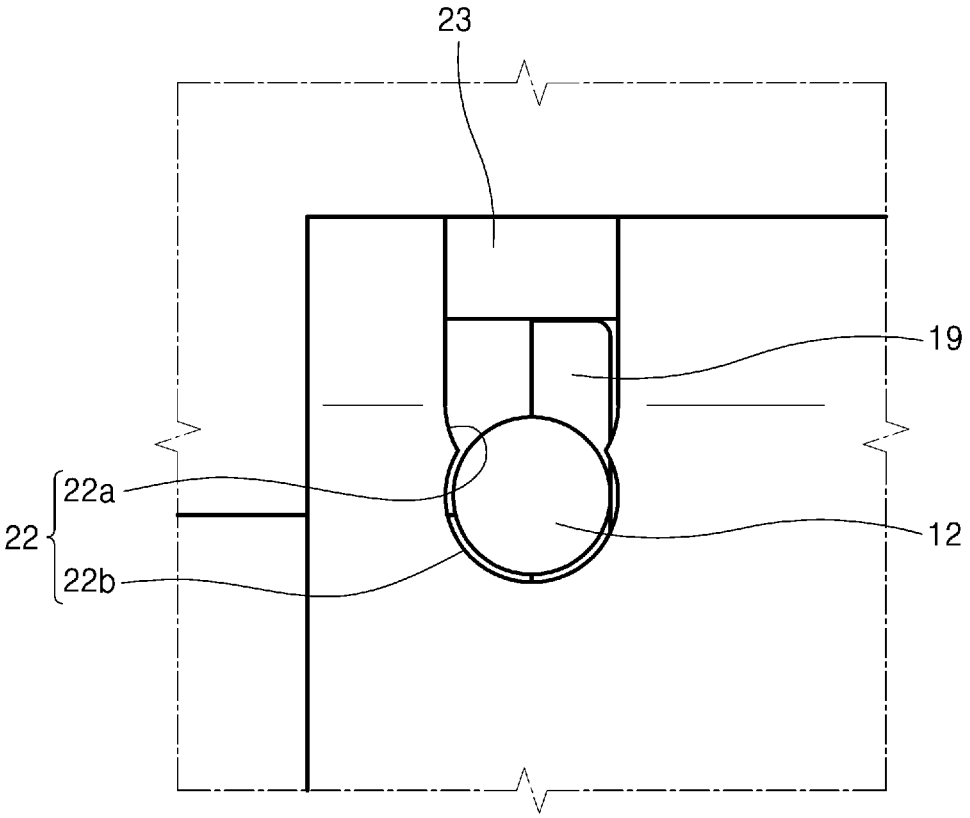
FIG. 12 is an enlarged side view of a portion of the aerosol generating source support assembly according to the exemplary embodiment of FIG. 11.

FIG. 12 is an enlarged side view of a portion of the aerosol generating source support assembly according to the exemplary embodiment of FIG. 11.

Referring to FIGS. 9 and 12, the inner cylinder 10 further includes an inner top plate 19 extending outward from an insertion opening of an upper end portion of the inner cylinder 10. When the inner cylinder 10 reaches the separation position shown in FIG. 12 by rotating with respect to the outer cylinder 20, an end portion of the edge of the inner top plate 19 comes into contact with the lower surface of the top plate 23 of the outer cylinder 20. That is, in the separation position in which the inner cylinder 10 has rotated with respect to the outer cylinder 20, the end portion of the edge of the inner top plate 19 of the inner cylinder 10 is strongly stuck to the lower surface of the top plate 23 of the outer cylinder 20, and thus, the position of the inner cylinder 10 with respect to the outer cylinder 20 may be fixed to the separation position.

As described above, since the inner cylinder 10 may rotate between the coupling position, in which the inner cylinder 10 is coupled to the outer cylinder 20, and the separation position, in which the inner cylinder 10 rotates with respect to the outer cylinder 20 to be separated from the outer cylinder 20, a cleaning operation may be easily performed. In particular, since the inner cylinder 10 is fixed in the separation position in which the inner cylinder 10 has been rotated with respect to the outer cylinder 20 as indicted by the solid line in FIG. 11, the user may easily clean the aerosol generating source support assembly.

Figure 13:
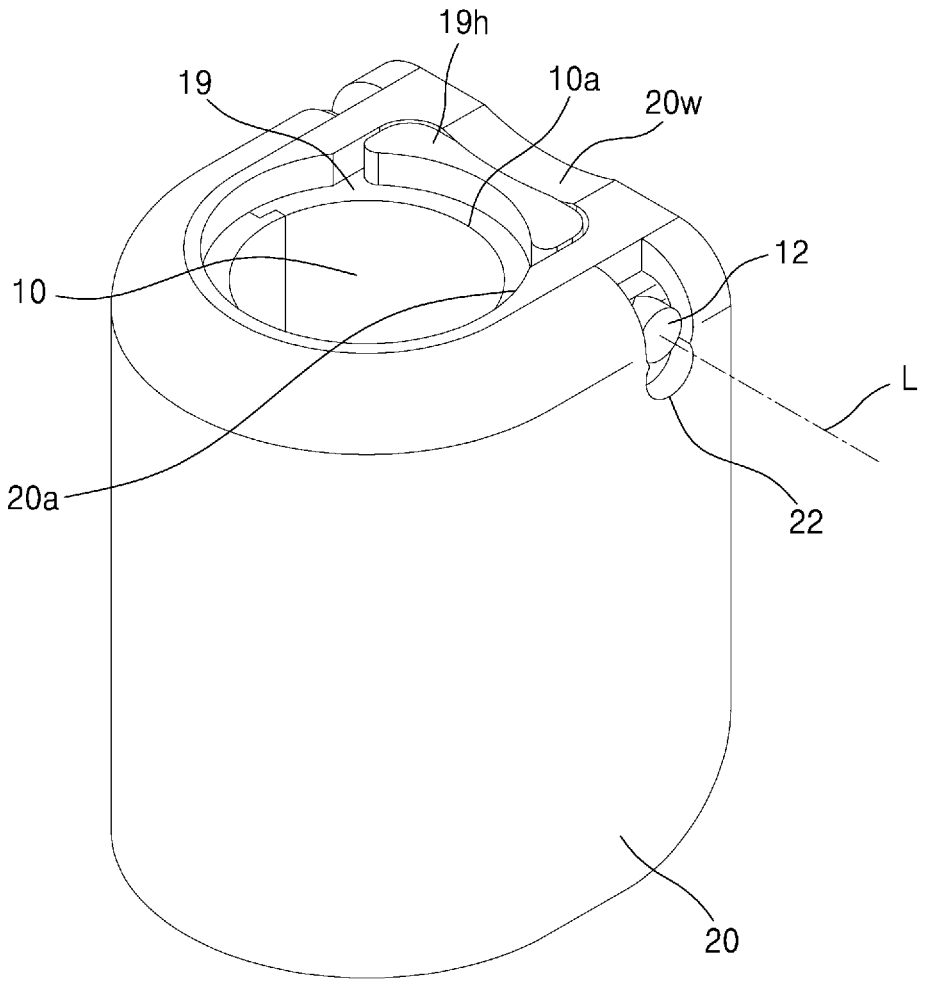
FIG. 13 is a perspective view of an aerosol generating source support assembly according to another exemplary embodiment.
Figure 14A:
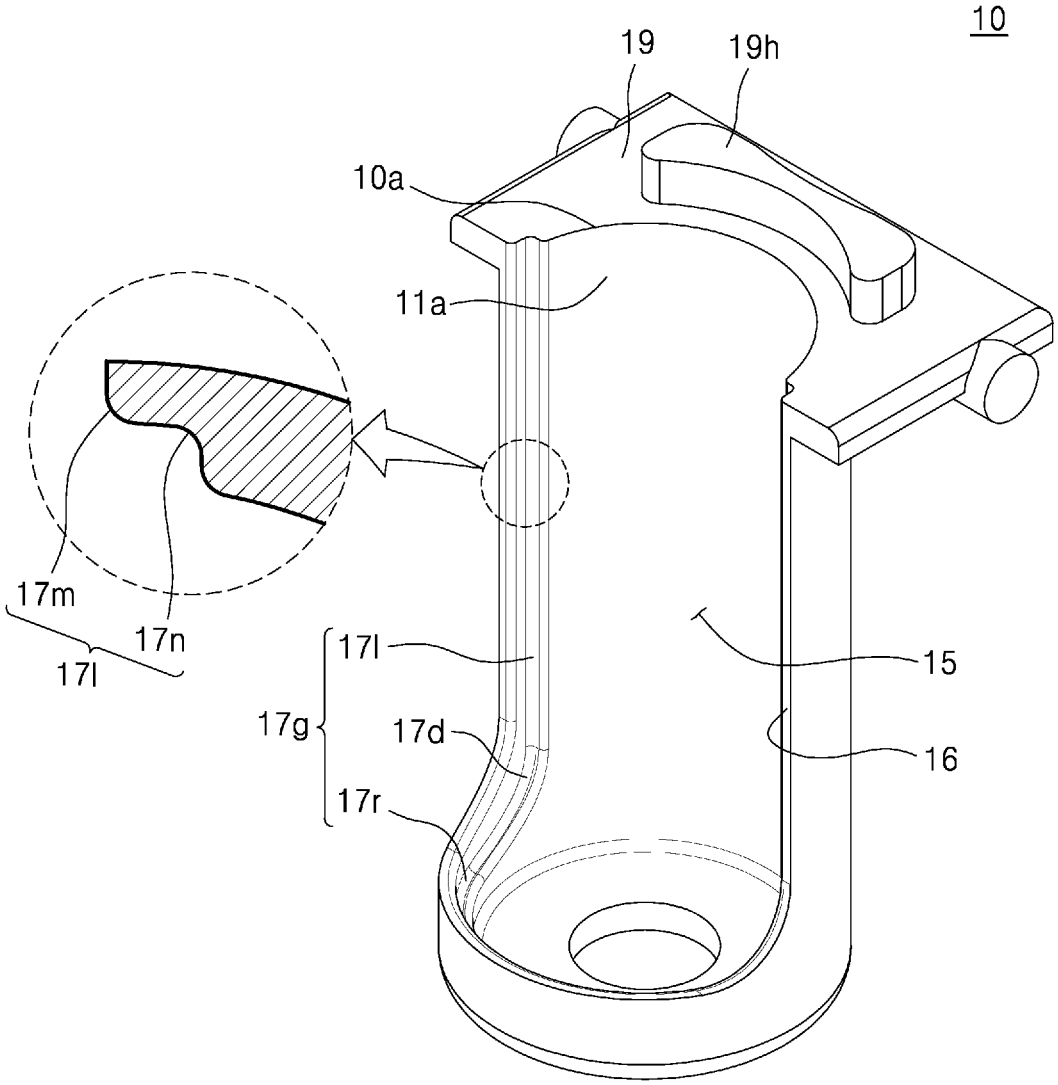
FIG. 14A is a perspective view illustrating some components of the aerosol generating source support assembly according to the exemplary embodiment shown in FIG. 13.
Figure 14B:
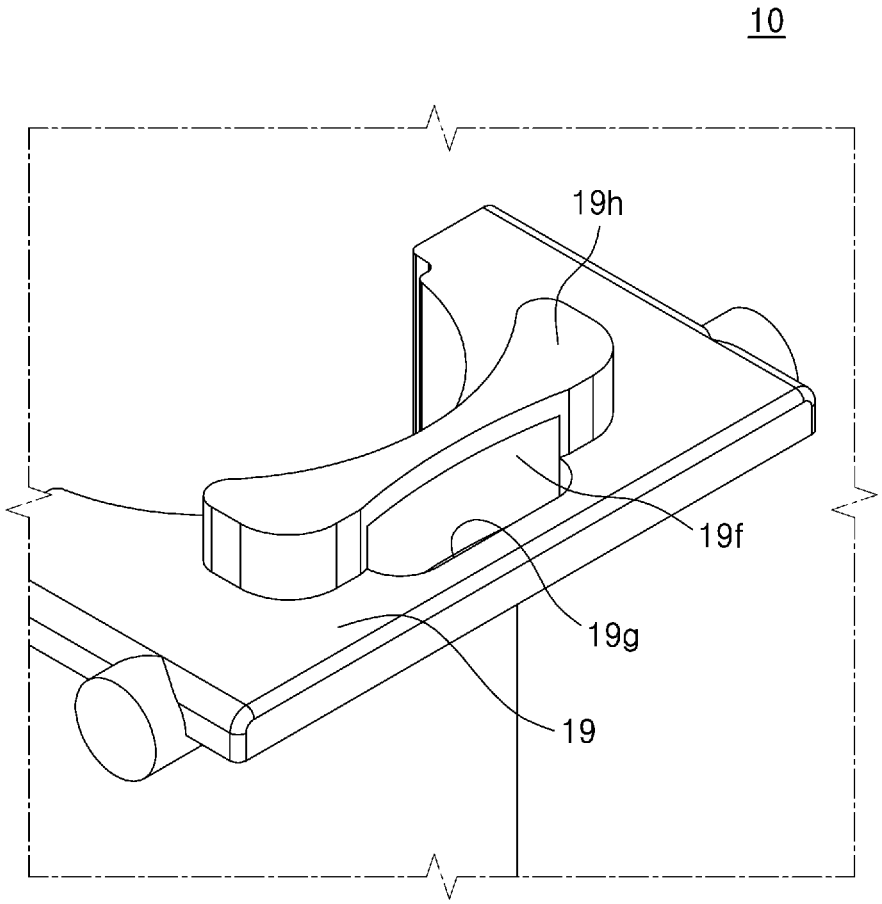
FIG. 14B is a perspective view illustrating, at a different angle, some components of the aerosol generating source support assembly shown in FIG. 14A.
Figure 15A:
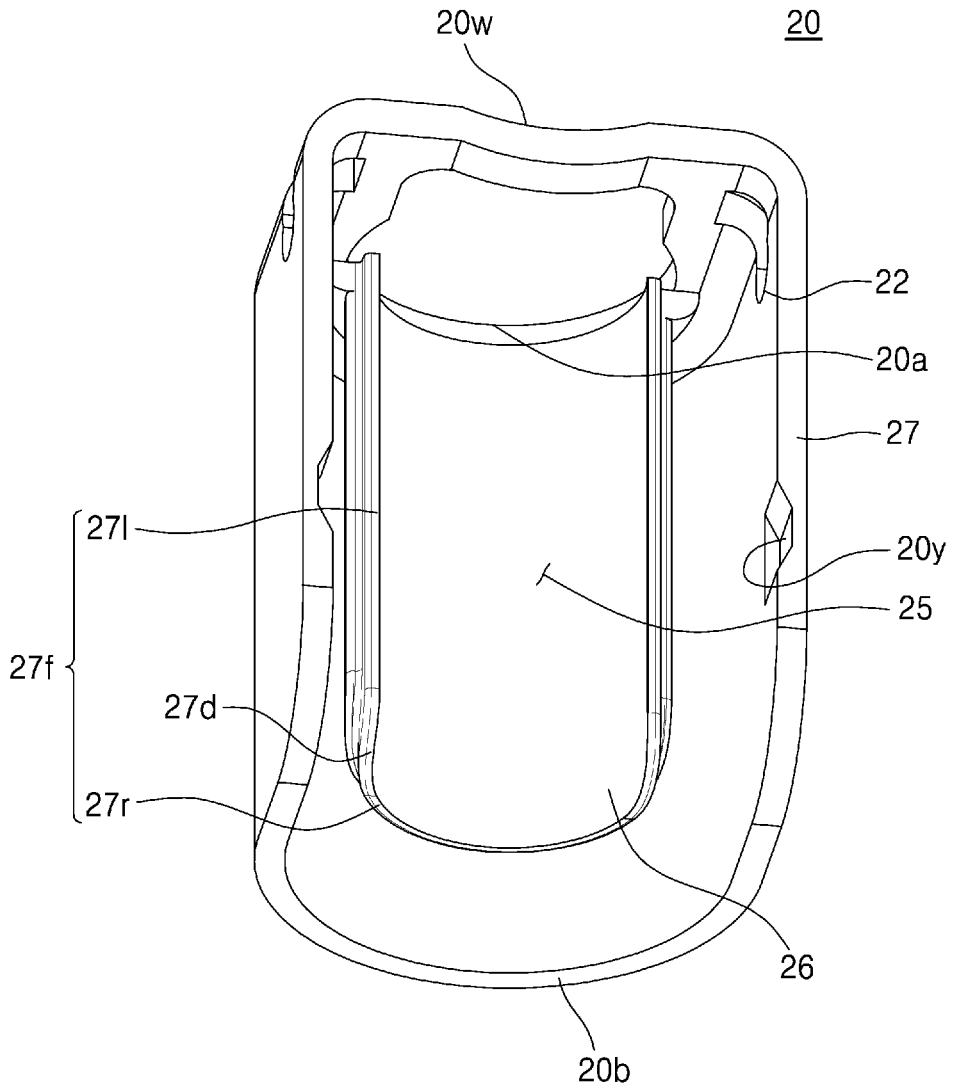
FIG. 15A is a perspective view illustrating some other components of the aerosol generating source support assembly according to the exemplary embodiment shown in FIG. 13.

FIG. 13 is a perspective view of an aerosol generating source support assembly according to another exemplary embodiment. FIG. 14A is a perspective view illustrating some components of the aerosol generating source support assembly according to the exemplary embodiment shown in FIG. 13. FIG. 14B is a perspective view illustrating, at a different angle, some components of the aerosol generating source support assembly shown in FIG. 14A. FIG. 15A is a perspective view illustrating some other components of the aerosol generating source support assembly according to the exemplary embodiment shown in FIG. 13.

The aerosol generating source support assembly according to the exemplary embodiment shown in FIG. 13 includes an inner cylinder 10 which is hollow and has an empty interior, and an outer cylinder 20 having a rotation hole 22 connected to a shaft 12 of the inner cylinder 10 and rotatably supporting the inner cylinder 10 about an axis L.

The inner cylinder 10 includes an inner top plate 19 extending outward from an insertion opening 10*a* of an upper end portion of the inner cylinder 10, and a handle 19*h* protruding from the inner top plate 19 toward one side opening 20*a* of the outer cylinder 20.

Referring to FIG. 14B, the handle 19*h* has a groove grip 19*f* formed to be concave on the back of the handle 19*h* so that the user may grip with a nail. The groove grip 19*f* serves to prevent slippage when the user grips and operates the handle 19*h*. In addition, the inner top plate 19 has an entry portion 19*g* that provides a hole at a portion in contact with the groove grip 19*f* of the handle 19*h*. When the user's finger grips the handle 19*h*, the end of the finger may enter the entry portion 19*g*, and thus, the gripping operation of the groove grip 19*f* using the nail may be stably performed.

In FIG. 14B, the entry portion 19*g* is formed as a hole penetrated in the vertical direction, but exemplary embodiments are not limited by the configuration of the entry portion 19*g*. For example, the entry portion 19*g* may have the shape of a concave groove.

Referring to FIG. 13, the one side opening 20*a* of the outer cylinder 20 is enlarged outward from the center of the one side opening 20*a* to expose the handle 19*h* of the inner cylinder 10 to the outside.

When the inner cylinder 10 is in a coupling position in which the inner cylinder 10 is coupled to the outer cylinder 20 and accommodated in the outer cylinder 20, as shown in FIG. 13, the handle 19*h* on the upper side of the inner cylinder 10 is exposed to the outside. Therefore, the user may rotate the inner cylinder 10 with respect to the outer cylinder 20 by operating the handle 19*h* using a finger while holding the outer cylinder 20 by hand.

A concave portion 20*w* to facilitate the insertion of the user's finger is formed adjacent to the handle 19*h*, at the edge of the one side opening 20*a* of the outer cylinder 20.

Exemplary embodiment are not limited by the configuration of the handle 19*h*. For example, the handle 19*h* may have a concave shape on the inner top plate 19 of the inner cylinder 10.

Referring to FIG. 14A, the inner cylinder 10 includes a cut-out hole 16 to open a portion of a support space 15 to the outside for easy cleaning.

Referring to FIG. 15A, the outer cylinder 20 is hollow and has an accommodation space 25 to accommodate the inner cylinder 10 in the coupling position. The outer cylinder 20 includes one side opening 20*a* for opening one end of the accommodation space 25 to the outside, a lower side opening 26*b* for opening the other end of the accommodation space 25 to the outside, and an open passage 27 for opening the accommodation space 25 in the lateral direction.

In addition, the outer cylinder 20 has the extended support surface 26 protruding from the inner wall surface of the outer cylinder 20 so as to be coupled to the cut-out hole 16 of the inner cylinder 10 in the coupling position where the outer cylinder 20 is coupled to the inner cylinder 10.

When the outer cylinder 20 and the inner cylinder 10 is coupled to each other to be in the coupling position, the extended support surface 26 may be connected to the inner wall surface 11*a* of the inner cylinder 10, thereby extending in the circumferential direction in order to contact, surround, and support at least a portion of a cigarette. The extended support surface 26 of the outer cylinder 20 in the coupling position and the inner wall surface 11*a* of the inner cylinder 10 may form a circular shape corresponding to the cross-sectional shape of the cigarette.

The extended support surface 26 of the outer cylinder 20 has a protruding border 27*f* protruding and extending along the edge of the extended support surface 26. In addition, the cut-out hole 16 of the inner cylinder 10 has a groove 17*g* extending along the edge of the cut-out hole 16.

When the inner cylinder 10 rotates to the coupling position and is accommodated in the outer cylinder 20, the protruding border 27*f* of the outer cylinder 20 may be inserted into the groove 17*g* of the inner cylinder 10, and thus, the coupling position in which the inner cylinder 10 and the outer cylinder 20 are coupled to each other may be stably maintained.

Referring to FIG. 14A, the groove 17*g* has a straight portion 17*l* extending linearly in the extending direction of the inner cylinder 10, and a curved portion 17*r* connected to the straight portion 17l near a lower end portion of the inner cylinder 10 and extending in the circumferential direction of the inner cylinder 10. A connection portion 17*d* between the straight portion 17*l* and the curved portion 17*r* is formed to be curved.

Referring to FIG. 15A, the protruding border 27*f* of the outer cylinder 20 also includes a straight portion 271 extending in the extending direction of the outer cylinder 20, a curved portion 27*r*, and a connection portion 27*d* so as to correspond to the shape of the groove 17*g* of the inner cylinder 10.

When the inserting direction of a cigarette does not coincide with the center of the inner cylinder 10 when the cigarette is inserted into the inner cylinder 10 from the outside, and forms an inclined state, the cigarette may not be easily inserted in the inner cylinder 10.

According to the configuration of the aerosol generating source support assembly according to the exemplary embodiment described above, the connection portion 17*d* between the straight portion 17*l* and the curved portion 17*r* is formed to be curved, and thus, the connection portion 17*d* may smoothly guide an end portion of the cigarette inserted into the inner cylinder 10 in the inclined state. Therefore, the cigarette may be inserted in a correct posture into the inner cylinder 10 as the posture of the cigarette is modified by the connection portion 17*d*.

FIG. 14A includes an enlarged cross-sectional view illustrating a cross section of a portion of the straight portion 17*l* of the groove 17*g*. Referring to the cross-sectional view of FIG. 14A, the inner surface of the straight portion 17*l* includes curved areas 17*m* and 17*n*. The curved areas 17*m* and 17*n* may be formed over the entire area of the groove 17*g* that extends from the straight portion 17*l* to the connection portion 17*d* and the curved portion 17*r*.

When the cross-sectional shape of the corner of the groove 17*g* is a rectangular shape, debris generated in an aerosol generation process of the cigarette may accumulate in the corner. Thus, a cleaning operation may be difficult. However, in the aerosol generating source support assembly according to the exemplary embodiment described above, the cross section of the groove 17*g* of the cut-out hole 16 of the inner cylinder 10 includes the curved areas 17*m* and 17*n*, and thus, debris generated in the aerosol generation process of the cigarette may be easily removed from the groove 17*g*.

Figure 15B:
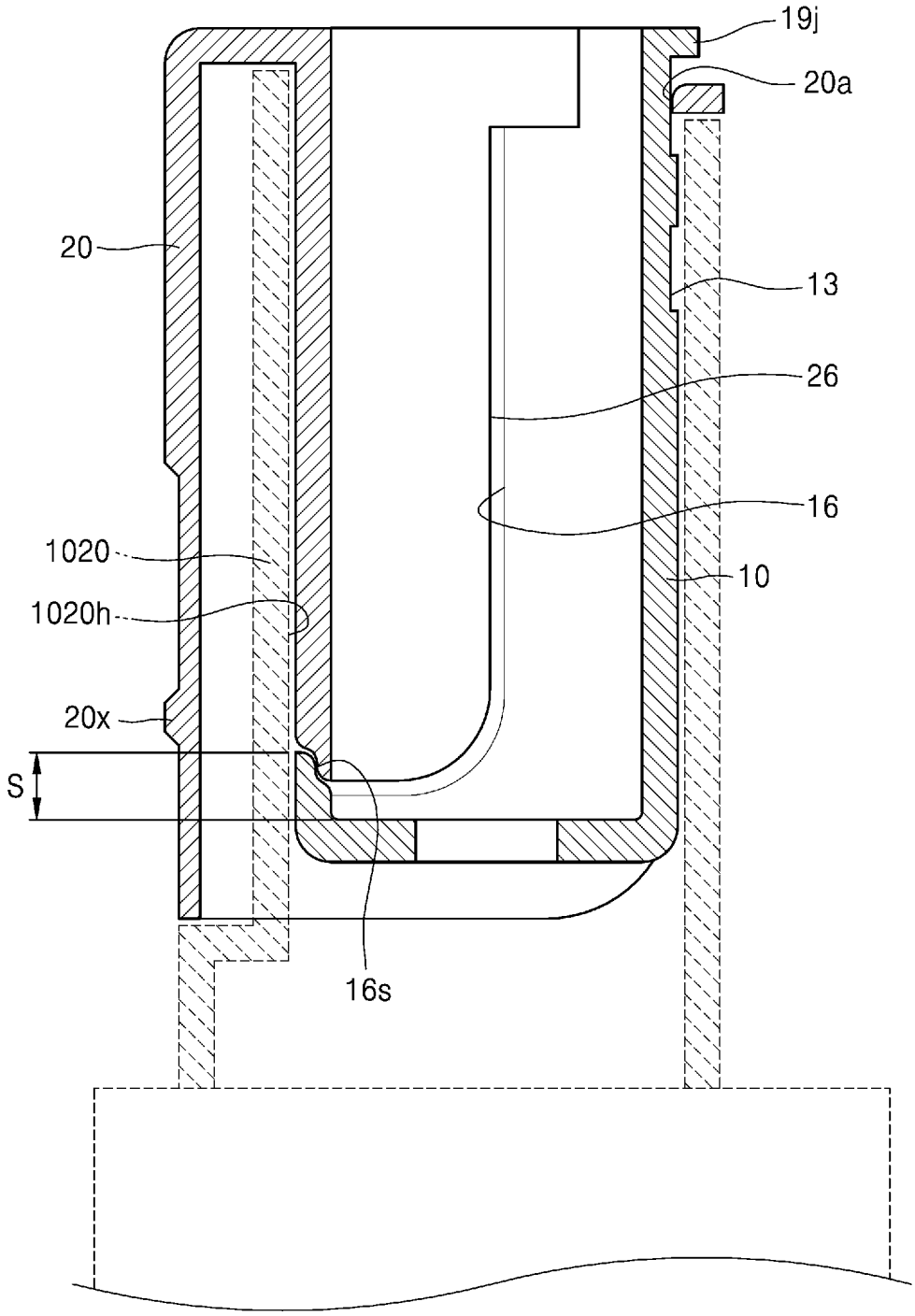
FIG. 15B is a side cross-sectional view of an aerosol generating source support assembly according to another exemplary embodiment.

FIG. 15B is a side cross-sectional view of an aerosol generating source support assembly according to another exemplary embodiment.

The aerosol generating source support assembly according to the exemplary embodiment shown in FIG. 15B includes an inner cylinder 10 and an outer cylinder 20 that supports the inner cylinder 10 such that the inner cylinder 10 may rotate between a coupling position and a separation position.

The inner cylinder 10 has a pressing knob 13 formed concave on the outer surface of the inner cylinder 10. In addition, the inner cylinder 10 has a handle 19*j* protruding upward through one side opening 20*a* of the outer cylinder 20 at an upper end portion of the inner cylinder 10. The handle 19*j* protrudes upward from the upper end of the one side opening 20*a* of the outer cylinder 20, and an end portion of the handle 19*j* has a shape bent outward.

According to the structure of the handle 19*j*, the area of the handle 19*j* that may be gripped by the user is large, and thus, the user may grip the handle 19*j* more easily and reliably. In addition, when the user moves the inner cylinder 10 with respect to the outer cylinder 20, the handle 19*j* and the pressing knob 13 of the inner cylinder 10 may be simultaneously gripped to apply force to the inner cylinder 10, and thus, an operation of changing the positions of the inner cylinder 10 and the outer cylinder 20 to the coupling position and a rotation position may be conveniently and stably performed.

When the inner cylinder 10 and the outer cylinder 20 are in the coupling position as shown in FIG. 15B, a cut-out hole 16 of the inner cylinder 10 and an extended support surface 26 of the outer cylinder 20 are coupled to each other, and thus, the outer cylinder 20 and the inner cylinder 10 form a space that may support the cigarette.

The inner cylinder 10 has a jaw 16*s* having a stepped shape at a lower portion of the cut-out hole 16 coupled with the extended support surface 26 of the outer cylinder 20. The jaw 16*s* having a stepped shape forms a height S from the bottom surface of the inner cylinder 10.

Therefore, when the aerosol generating source support assembly according to the exemplary embodiment shown in FIG. 15B is coupled to the protrusion tube 1020, the movement of a substance generated in an inner space formed by the inner cylinder 10 and the outer cylinder 20 to surround the cigarette is blocked by the jaw 16*s* having a stepped shape. That is, a substance in the inner space formed by the inner cylinder 10 and the outer cylinder 20 may be effectively blocked by the jaw 16*s* having a stepped shape so as not to leak toward the coupling passage 1020*h* of the protrusion tube 1020.

In FIG. 15B, the jaw 16*s* is shown as a stepped shape with two steps, but the exemplary embodiment is not limited by the specific shape of the jaw 16*s* and the jaw 16*s* may have a stepped shape with three or more steps.

Figure 16:
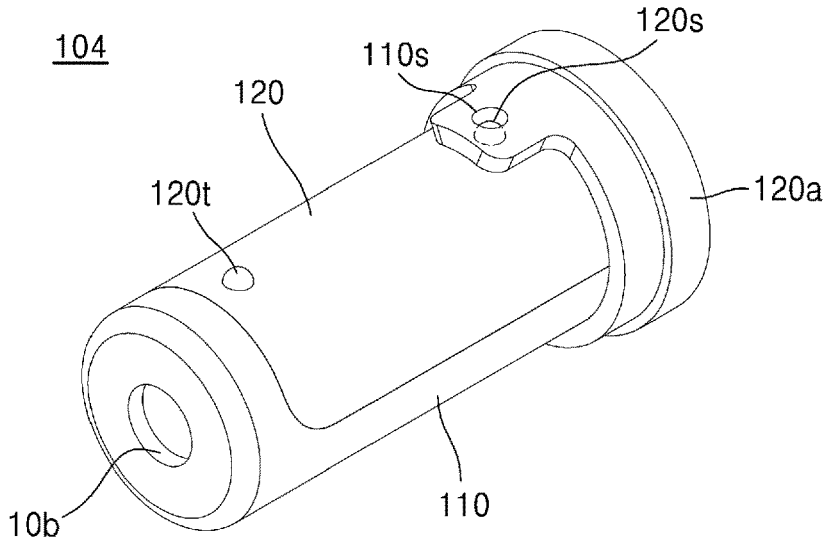
FIG. 16 is a perspective view of an aerosol generating source support assembly according to another exemplary embodiment.
Figure 17:
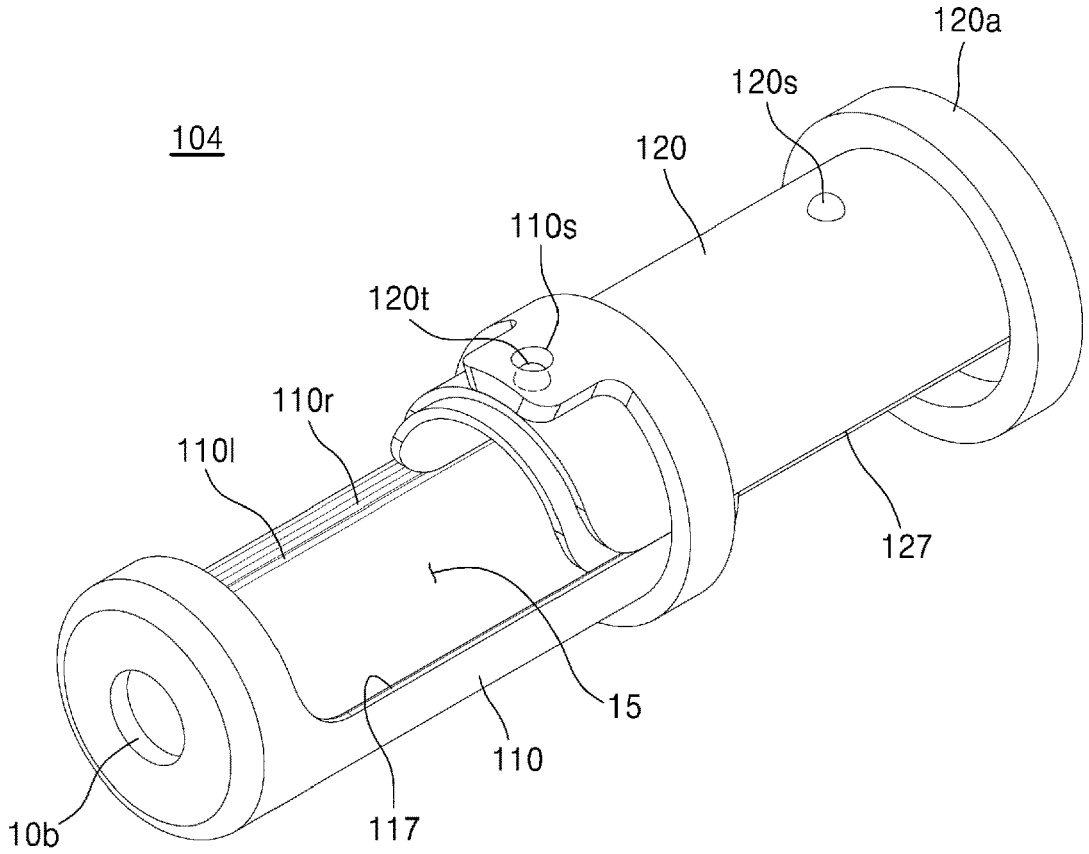
FIG. 17 is a perspective view illustrating an operating state of the aerosol generating source support assembly according to the exemplary embodiment shown in FIG. 16.
Figure 18:
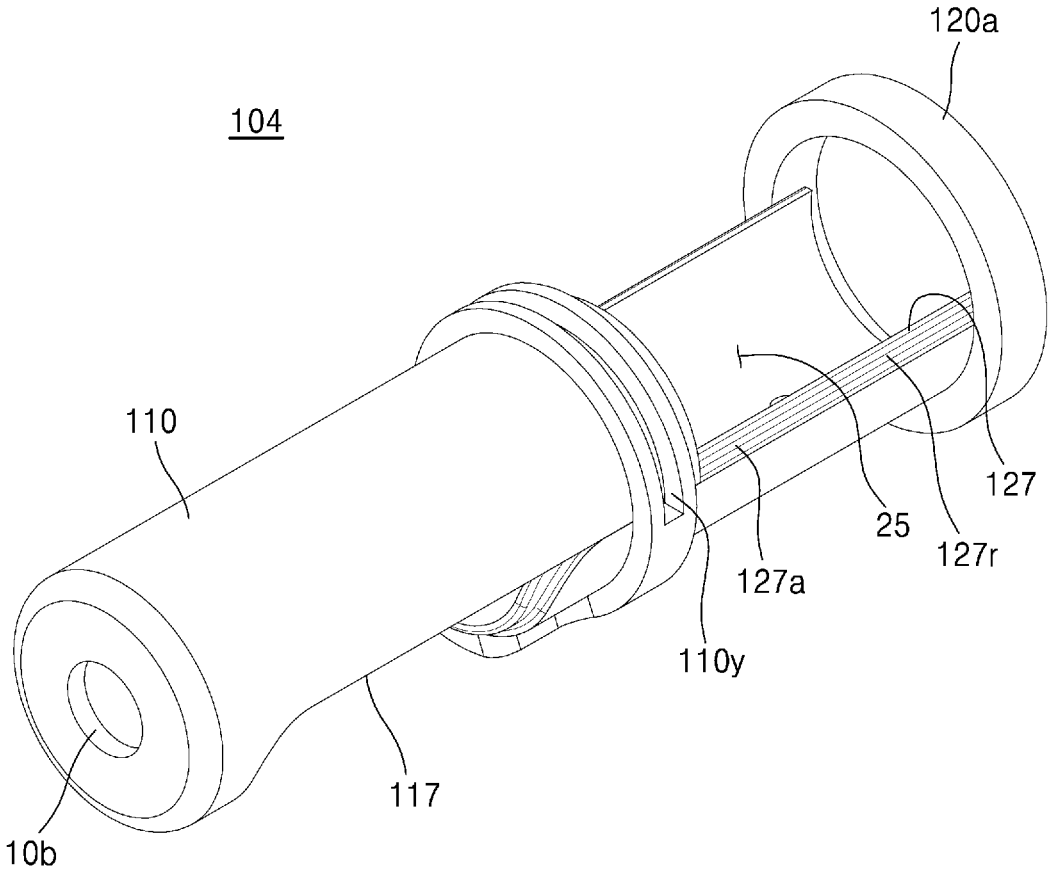
FIG. 18 is a perspective view of the back of the aerosol generating source support assembly according to the exemplary embodiment shown in FIG. 17.

FIG. 16 is a perspective view of an aerosol generating source support assembly according to another exemplary embodiment. FIG. 17 is a perspective view illustrating an operating state of the aerosol generating source support assembly according to the exemplary embodiment shown in FIG. 16. FIG. 18 is a perspective view of the back of the aerosol generating source support assembly according to the exemplary embodiment shown in FIG. 17.

The aerosol generating source support assembly 104 according to the exemplary embodiment shown in FIGS. 16 to 18 has an inner cylinder 110, which is hollow and may surround and support at least a portion of an aerosol generating source, and an outer cylinder 120 for movably supporting the inner cylinder 110 such that the inner cylinder 110 may move between a coupling position and a separation position.

In the aerosol generating source support assembly 104 according to the exemplary embodiment shown in FIGS. 16 to 18, the inner cylinder 110 is modified to move linearly with respect to the outer cylinder 120. The inner cylinder 110 is coupled to the outer cylinder 120 to move linearly with respect to the outer cylinder 120 in a direction in which the outer cylinder 120 extends.

Referring to FIG. 18, the outer cylinder 120 is hollow and has an accommodation space 25 having an empty interior. The outer cylinder 120 is manufactured in a substantially semi-cylindrical shape so as to surround and support at least another portion of the aerosol generating source, i.e. a cigarette. The outer cylinder 120 has an outer cylinder cut-out hole 127 for exposing at least a portion of the accommodation space 25 to the outside.

Referring to FIG. 17, the inner cylinder 110 is hollow and has a support space 15. The inner cylinder 110 is manufactured in a substantially semi-cylindrical shape so as to surround and support at least a portion of a cigarette which is an aerosol generating source. The inner cylinder 110 exposes the support space 15 to the outside and has an inner cylinder cut-out hole 117 with a shape corresponding to the outer cylinder cut-out hole 127 of the outer cylinder 120.

The exemplary embodiment is not limited by the configurations of the inner cylinder 110 and the outer cylinder 120 shown as having semi-cylindrical shapes. For example, one of the inner cylinder 110 and the outer cylinder 120 may have an acute arc-shaped cross section, and the other of the inner cylinder 110 and the outer cylinder 120 may have an obtuse arc-shaped cross section corresponding to the acute arc-shaped cross section.

The outer cylinder 120 has an insertion opening 120*a* that allows the aerosol generating source to be inserted, at one end portion of the outer cylinder 120.

The inner cylinder 110 may include a heater insertion opening 10*b* provided at an opposite end portion of the inner cylinder 110 which is opposite to the insertion opening 120*a* of the outer cylinder 120.

The position of the inner cylinder 110 may be changed to a coupling position in which the inner cylinder 110 and the outer cylinder 120 are coupled to each other, as shown in FIG. 16, or may be changed to a separation position in which at least a portion of the inner cylinder 110 is separated from the outer cylinder 120, as shown in FIGS. 17 and 18.

When the inner cylinder 110 and the outer cylinder 120 are in the coupling position shown in FIG. 16, both the outer cylinder cut-out hole 127 and the inner cylinder cut-out hole 117 are closed, and thus, the inner cylinder 110 and the outer cylinder 120 may form an aerosol generating source insertion space to accommodate an aerosol generating source therein.

Since the outer cylinder cut-out hole 127 and the inner cylinder cut-out hole 117 are exposed to the outside when the inner cylinder 110 and the outer cylinder 120 are in the separation position shown in FIGS. 17 and 18, a cleaning operation may be conveniently performed.

Referring to FIGS. 17 and 18, rails 127*a*, 1101 for guiding the linear movement of the inner cylinder 110 are installed in an area between the outer cylinder 120 and the inner cylinder 110, in which the outer cylinder cut-out hole 127 and the inner cylinder cut-out hole 117 are engaged with each other. The rail 127*a*, 1101 may include a straight protruding portion 127*a* and a straight groove 1101 to accommodate the straight protruding portion, which extend in a direction in which the outer cylinder 120 and the inner cylinder 110 extend. The straight protruding portion 127*a* may be installed in either the outer cylinder 120 or the inner cylinder 110, and the straight groove 1101 may be installed in the other.

Each of the outer cylinder cut-out hole 127, the inner cylinder cut-out hole 117, and the rails 127*a*, 1101 includes curved areas 127*r*, 110*r*. The curved areas 127*r*, 110*r* may be formed over the entire area where the rails 127*a*, 1101 extend.

When the cross-sectional shapes of the corners of the rails 127*a* and 1101 are rectangular shapes, debris generated in an aerosol generation process of the cigarette may accumulate in the corners and thus, a cleaning operation may be difficult. However, in the aerosol generating source support assembly according to the exemplary embodiment described above, each of the rails 127*a*, 1101 includes the curved areas 127*r*, 110*r*, and thus, debris generated during the aerosol generation process of the cigarette may be easily removed.

A fixing device for fixing the positions of the outer cylinder 120 and the inner cylinder 110 is installed between the outer cylinder 120 and the inner cylinder 110. The fixing device includes a first stopper 120*s* and a second stopper 120*t* arranged to protrude on an outer surface of the outer cylinder 120, and an accommodation groove 110*s* installed in the inner cylinder 110 to support the first stopper 120*s* and the second stopper 120*t*.

The first stopper 120*s* and the second stopper 120*t* have a substantially hemispherical shape having a substantially arc-shaped cross-sectional shape. Therefore, the outer surface of each of the first stopper 120*s* and the second stopper 120*t* is curved. Due to the structures of the first stopper 120*s* and the second stopper 120*t*, an operation in which the first stopper 120*s* and the second stopper 120*t* enter the accommodation groove 110*s* may be smoothly performed.

The inner cylinder 110 has a grip handle 110*y* having a concave groove shape and extending in the circumferential direction so that a user may grip and operate it by hand. The user may easily and conveniently change the positions of the inner cylinder 110 and the outer cylinder 120 in a state of gripping the grip handle 110*y*. The exemplary embodiment is not limited by the shape of the grip handle 110*y*. For example, the grip handle 110*y* may have a shape protruding outward from the inner cylinder 110.

In the coupling position of FIG. 16, the accommodation groove 110*s* accommodates the first stopper 120*s*, thereby stably maintaining a state in which the outer cylinder 120 and the inner cylinder 110 are coupled to each other.

In the separation position shown in FIGS. 17 and 18, the accommodation groove 110*s* accommodates the second stopper 120*t*, thereby stably maintaining a state in which the outer cylinder 120 and the inner cylinder 110 are separated from each other.

As described above, since the inner cylinder 110 may linearly moves between a coupling position, in which the inner cylinder 110 is coupled to the outer cylinder 120, and a separation position, in which the inner cylinder 110 is separated from the outer cylinder 120, a cleaning operation may be conveniently performed. In particular, since the outer cylinder 120 and the inner cylinder 110 are fixed in the separation position by the action of the fixing device, the user may conveniently perform the cleaning of the aerosol generating source support assembly which is maintained in the state shown in FIGS. 17 and 18.

While exemplary embodiments of the present disclosure have been illustrated and described in detail with reference to the accompanying drawings, it will be clear that the present disclosure is not limited to these exemplary embodiments only. Numerous modifications, changes, variations, substitutions, and equivalents will be apparent to those skilled in the art. Therefore, it is intended that the specification and examples be considered as exemplary only, with the true scope and spirit of the disclosure being indicated by the appended claims.

INDUSTRIAL APPLICABILITY

Exemplary embodiments relate to an aerosol generating source support assembly that is easy to clean and an aerosol generating apparatus including the aerosol generating source support assembly.

What is claimed is:

1. An aerosol generating source support assembly comprising:

an inner cylinder which is hollow, having a support space and an insertion opening which opens the support space to outside, and arranged to surround and support at least a portion of an aerosol generating source; and an outer cylinder which is hollow, having an accommodation space and a first side opening which opens the accommodation space to the outside, connected to the inner cylinder, and arranged to movably support the inner cylinder such that the inner cylinder moves between a first position and a second position in which at least a portion of the inner cylinder that is coupled to the outer cylinder in the first position is separated from the outer cylinder, wherein, in the first position, the insertion opening of the inner cylinder is aligned with the first side opening of the outer cylinder to form an insertion hole for receiving the aerosol generating source, and wherein a part of the aerosol generating source projects out of the insertion hole when the aerosol generating source is inserted into the insertion hole, such that a user inhales an aerosol through the projecting part of the aerosol generating source.

2. The aerosol generating source support assembly of claim 1, wherein the inner cylinder is rotatably coupled to the outer cylinder such that the inner cylinder rotates between the first position and the second position, and wherein the inner cylinder is accommodated in the outer cylinder in the first position and at least a portion of the inner cylinder protrudes out of the outer cylinder in the second position.

3. The aerosol generating source support assembly of claim 2, wherein the outer cylinder further includes a second side opening at an opposite end of the accommodation space, and an open passage which opens the accommodation space to the outside in a different direction than the first side opening, wherein the inner cylinder is rotatably coupled to the outer cylinder such that the inner cylinder rotates about an axis crossing an extension direction in which the outer cylinder extends toward the second side opening from the first side opening, and at least a portion of the inner cylinder protrudes out of the accommodation space through the open passage when the inner cylinder rotates from the first position to the second position.

4. The aerosol generating source support assembly of claim 3, wherein the inner cylinder further includes a shaft protruding toward the outer cylinder, and the outer cylinder further includes a rotation hole through which the shaft is inserted and rotated.

5. The aerosol generating source support assembly of claim 4, wherein the inner cylinder further includes a pressing knob on an outer surface thereof to enable a user to operate the inner cylinder.

6. The aerosol generating source support assembly of claim 4, wherein the inner cylinder further includes a stopper protruding outward from the shaft, and wherein the outer cylinder includes a top plate extending outward from the first side opening, the top plate contacting and supporting the stopper when the inner cylinder rotates toward the second position.

7. The aerosol generating source support assembly of claim 4, wherein the inner cylinder further includes an inner top plate extending out of the insertion opening, and a handle arranged on the inner top plate to face the first side opening of the outer cylinder, and wherein the first side opening of the outer cylinder extends outward from a center of the first side opening to expose the handle to the outside.

8. The aerosol generating source support assembly of claim 3, wherein the inner cylinder further includes, at the other end thereof, a heater insertion opening.

9. The aerosol generating source support assembly of claim 3, wherein the inner cylinder further includes a cut-out hole to open a portion of the support space to the outside for cleaning, and the outer cylinder further includes an extended support surface, and wherein, in the first position, the extended support surface is coupled to the cut-out hole of the inner cylinder and connected to an inner wall surface of the inner cylinder, thereby surrounding and supporting at least a portion of the aerosol generating source.

10. The aerosol generating source support assembly of claim 9, wherein one of the cut-out hole of the inner cylinder and the extended support surface of the outer cylinder is provided with a groove extending along an edge of the cut-out hole or the extended support surface, and the other of the cut-out hole of the inner cylinder and the extended support surface of the outer cylinder is provided with a protruding border extending along the edge of the cut-out hole or the extended support surface and inserted into the groove.

11. The aerosol generating source support assembly of claim 10, wherein each of the groove and the protruding border includes a straight portion extending in an extension direction of the inner cylinder and the outer cylinder, and a curved portion which is connected to the straight portion near the other end of the inner cylinder, and extending in a circumferential direction of the inner cylinder, wherein a connection portion between the straight portion and the curved portion is curved.

12. The aerosol generating source support assembly of claim 9, wherein the inner cylinder includes a jaw having a stepped shape in a portion of the cut-out hole coupled to the extended support surface of the outer cylinder such that the jaw prevents a substance inside the inner cylinder and the outer cylinder from leaking to the outside.

13. The aerosol generating source support assembly of claim 4, wherein the rotation hole extends along the extension direction of the outer cylinder to guide the shaft to move along the extension direction of the outer cylinder.

14. The aerosol generating source support assembly of claim 13, wherein the rotation hole includes a protruding jaw protruding from the rotation hole to support the shaft, wherein the inner cylinder is movable between a release position and a close-contact position corresponding to the first position, wherein, according to the inner cylinder moving from the release position to the close-contact position, the shaft moves beyond the protruding jaw toward the first side opening of the outer cylinder, and according to the inner cylinder moving from the close-contact position to the release position, the shaft moves beyond the protruding jaw toward the second side opening of the outer cylinder, and wherein, the inner cylinder is arranged to rotate with respect to the outer cylinder based on the shaft being in the release position.

15. The aerosol generating source support assembly of claim 13, wherein the inner cylinder further includes an inner top plate extending outside the insertion opening, and the outer cylinder further includes a top plate that extends outward from the first side opening and thus contacts an end portion of the inner top plate to hold the inner cylinder in the second position when the inner cylinder rotates with respect to the outer cylinder.

16. The aerosol generating source support assembly of claim 1, wherein the inner cylinder is movably coupled to the outer cylinder such that the inner cylinder moves with respect to the outer cylinder in a direction in which the outer cylinder extends, wherein the outer cylinder includes an outer cylinder cut-out hole for exposing at least a portion of the accommodation space to outside, wherein the inner cylinder includes an inner cylinder cut-out hole that exposes the support space to the outside and has a shape corresponding to the outer cylinder cut-out hole, and wherein both the outer cylinder cut-out hole and the inner cylinder cut-out hole are closed in the first position to form an aerosol generating source insertion space for accommodating the aerosol generating source, and the outer cylinder cut-out hole and the inner cylinder cut-out hole are exposed to the outside in the second position.

17. The aerosol generating source support assembly of claim 16, wherein a rail for guiding linear movement of the inner cylinder is installed between the outer cylinder and the inner cylinder, in an area where the outer cylinder cut-out hole and the inner cylinder cut-out hole are engaged with each other.

18. The aerosol generating source support assembly of claim 16, wherein a stopper for maintaining a position is installed in one of the inner cylinder and the outer cylinder, and an accommodation groove coupled to the stopper is installed in the other of the inner cylinder and the outer cylinder.

19. The aerosol generating source support assembly of claim 16, wherein the outer cylinder further includes, at one end thereof, an insertion opening into which the aerosol generating source is inserted, and wherein the inner cylinder further includes a heater insertion opening at an opposite end of the inner cylinder.

20. The aerosol generating apparatus of claim 1, wherein the inner cylinder is movably coupled to the outer cylinder such that the inner cylinder slides linearly with respect to the outer cylinder.

21. An aerosol generating apparatus comprising:

a case;

a hollow protrusion tube protruding from one end of the case and open to outside;

a heater installed in the case such that an end portion of the heater is positioned inside the protrusion tube, and configured to generate heat according to an electric signal being applied; and an aerosol generating source support assembly mounted on the protrusion tube and separable from the protrusion tube, the aerosol generating source support assembly including:

an inner cylinder which is hollow, having a support space and an insertion opening which opens the support space to outside, and arranged to surround and support at least a portion of an aerosol generating source; and an outer cylinder which is hollow, having an accommodation space and a side opening which opens the accommodation space to the outside, connected to the inner cylinder, and arranged to movably support the inner cylinder such that the inner cylinder moves between a first position and a second position in which at least a portion of the inner cylinder that is coupled to the outer cylinder in the first position is separated from the outer cylinder, wherein, in the first position, the insertion opening of the inner cylinder is aligned with the side opening of the outer cylinder to form an insertion hole for receiving the aerosol generating source, wherein a part of the aerosol generating source projects out of the insertion hole when the aerosol generating source is inserted into the insertion hole, such that a user inhales an aerosol through the projecting part of the aerosol generating source, and wherein the aerosol generating source support assembly is detachably coupled to the hollow protrusion tube.

* * * * *